US012535242B2

(12) United States Patent
Hwang et al.

(10) Patent No.: US 12,535,242 B2
(45) Date of Patent: Jan. 27, 2026

(54) AIR CONDITIONER

(71) Applicant: SAMSUNG ELECTRONICS CO., LTD., Suwon-si (KR)

(72) Inventors: Jun Hwang, Suwon-si (KR); Hyungjin Kwon, Suwon-si (KR); Jinbaek Kim, Suwon-si (KR); Kyutae Park, Suwon-si (KR); Nayeong Byeon, Suwon-si (KR); Yongho Seo, Suwon-si (KR); Seonghyun Yoon, Suwon-si (KR); Joonho Yoon, Suwon-si (KR); Eunsung Jo, Suwon-si (KR); Donggi Han, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 414 days.

(21) Appl. No.: 18/110,502

(22) Filed: Feb. 16, 2023

(65) Prior Publication Data

US 2023/0194122 A1 Jun. 22, 2023

Related U.S. Application Data

(63) Continuation of application No. PCT/KR2021/010040, filed on Aug. 2, 2021.

(30) Foreign Application Priority Data

Sep. 1, 2020 (KR) ..... 10-2020-0111201

(51) Int. Cl.
*F24F 13/08* (2006.01)
*F24F 1/0284* (2019.01)

(52) U.S. Cl.
CPC ..... *F24F 13/082* (2013.01); *F24F 1/0284* (2019.02)

(58) Field of Classification Search
CPC ..... F24F 1/0033; F24F 1/0284; F24F 1/0029; F24F 1/0011; F24F 13/08; F24F 13/20; F24F 13/082; F24F 2221/28
See application file for complete search history.

(56) References Cited

U.S. PATENT DOCUMENTS 9,557,070 B2 1/2017 Song et al.
9,995,494 B2 6/2018 Song et al.
(Continued)

FOREIGN PATENT DOCUMENTS

CN 104896590 B 10/2018
EP 1 950 502 A1 7/2008
(Continued)

OTHER PUBLICATIONS

International Search Report, PCT/ISA/210, dated Dec. 1, 2021, in International Application No. PCT/KR2021/010040.
(Continued)

*Primary Examiner* — Allen R. B. Schult
(74) *Attorney, Agent, or Firm* — STAAS & HALSEY LLP

(57) ABSTRACT

An air conditioner including a housing; a heat exchanger in the housing; an outlet; a blower to discharge air forward toward the outlet, the air having exchanged heat with the heat exchanger; and a guide panel in front of the blower, and including an inner panel coupled with the outer panel, and a suck-in flow path formed by the inner panel and the outer panel, wherein the guide panel forms the outlet with the housing to release a first portion of the air discharged by the blower outside of the housing, and the suck-in flow path sucks in a second portion of the air discharged by the blower so as to guide the first portion of the air to flow outside of the housing in a direction different than when the second portion of the air is not sucked into the suck-in flow path.

15 Claims, 16 Drawing Sheets

(56) References Cited

U.S. PATENT DOCUMENTS

| | | | | |
|---|---|---|---|---|
| 10,126,002 | B2 | 11/2018 | Song et al. | |
| 10,203,121 | B2 | 2/2019 | Song et al. | |
| 10,386,079 | B2 | 8/2019 | Kim et al. | |
| 10,627,130 | B2 | 4/2020 | Cho et al. | |
| 10,976,061 | B2 | 4/2021 | Kim et al. | |
| 11,035,583 | B2 | 6/2021 | Kim et al. | |
| 2006/0042288 | A1 | 3/2006 | Downs | |
| 2018/0347839 | A1* | 12/2018 | Kim | F24F 1/0022 |
| 2021/0215389 | A1 | 7/2021 | Chun et al. | |

FOREIGN PATENT DOCUMENTS

| | | |
|---|---|---|
| EP | 3 330 620 | 6/2018 |
| JP | 10-196997 | 7/1998 |
| JP | 2985801 | 12/1999 |
| JP | 5712990 | 5/2015 |
| KR | 10-0352443 | 9/2002 |
| KR | 2003-0073152 | 9/2003 |
| KR | 10-0484928 | 4/2005 |
| KR | 10-0487977 | 5/2005 |
| KR | 10-1430440 | 8/2014 |
| KR | 10-1563483 | 11/2015 |
| KR | 10-2016-0131841 | 11/2016 |
| KR | 10-2017-0018279 | 2/2017 |
| KR | 10-2017-0059509 | 5/2017 |
| KR | 10-2018-0055156 | 5/2018 |
| KR | 10-2018-0072630 | 6/2018 |
| KR | 10-2018-0087813 | 8/2018 |
| KR | 10-1916127 | 11/2018 |
| KR | 10-2019-0036840 | 4/2019 |
| KR | 10-2086581 | 3/2020 |
| KR | 10-2021-0090475 | 7/2021 |
| KR | 10-2379031 | 3/2022 |

OTHER PUBLICATIONS

Korean Office Action dated May 28, 2025 for Korean Application No. 10-2020-0111201.

* cited by examiner

AIR CONDITIONER

CROSS-REFERENCE TO RELATED APPLICATIONS

This application is a continuation application under 35 U.S.C. § 111(a) of international Application No. PCT/KR2021/010040, filed on Aug. 2, 2021, which claims priority to Korean Patent Application No. 10-2020-0111201, filed on Sep. 1, 2020, the disclosures of which are incorporated by reference herein in their entireties.

BACKGROUND

1. Field

The disclosure relates to an air conditioner, and more particularly, to an air conditioner having an enhanced air current control structure.

2. Description of the Related Art

An air conditioner is a device that uses a refrigeration cycle to keep indoor air pleasant to be suitable for human activity. The air conditioner may cool indoor space by repeating operations of sucking in hot indoor air, forcing the air to exchange heat with a cool refrigerant, and discharging the resultant air into the indoor space, or heat the indoor space by the reverse operations.

The air conditioner also provides a dehumidification function together with the air conditioning function. The dehumidification function provided by a general air conditioner involves a cooling effect, and there is a need to implement a dehumidification function that does not involve such a cooling effect at the request of users who just want pure dehumidification.

Researches on an air conditioner that is able to maintain pleasant indoor temperature while having wind velocity of cooling of the air conditioner almost imperceptible by keeping the discharging speed of air through an outlet of the air conditioner as low as possible are being actively conducted these days.

SUMMARY

Aspects of embodiments of the disclosure will be set forth in part in the description which follows and, in part, will be apparent from the description, or may be learned by practice of the presented embodiments.

According to an embodiment of the disclosure, an air conditioner may include a housing; a heat exchanger disposed in the housing; an outlet; a blower configured to discharge air forward toward the outlet, the air having exchanged heat with the heat exchanger; and a guide panel covering a front of the blower, and including an outer panel, an inner panel coupled with the outer panel, and a suck-in flow path formed by the inner panel and the outer panel. The guide panel may be configured so that the guide panel forms the outlet with the housing to release a first portion of the air discharged by the blower outside of the housing, and the suck-in flow path sucks in a second portion of the air discharged by the blower so as to guide the first portion of the air to flow outside of the housing in a direction different than when the second portion of the air is not sucked into the suck-in flow path.

According to an embodiment of the disclosure, the guide panel further includes a suction fan disposed in the suck-in flow path to form an air current in the suck-in flow path.

According to an embodiment of the disclosure, the inner panel is disposed behind the outer panel, and at least a portion of the suck-in flow path is disposed between the outer panel and the inner panel.

According to an embodiment of the disclosure, the suck-in flow path includes a flow-in port communicating with the outlet to bring in the second portion of the air, and a flow-out port configured to release the second portion of the air, brought in through the flow-in port, into the housing.

According to an embodiment of the disclosure, the flow-in port extends along a left edge, a top edge, and a right edge of the guide panel.

According to an embodiment of the disclosure, the flow-in port includes a plurality of flow-in ports respectively formed at a left edge, a top edge, and a right edge of the guide panel.

According to an embodiment of the disclosure, the suck-in flow path includes a plurality of suck-in flow paths, each including a flow-in port communicating with the outlet to bring in the second portion of the air, and the suction fan includes a plurality of suction fans respectively corresponding to each of the plurality of suck-in flow paths.

According to an embodiment of the disclosure, the outlet is disposed to enclose the left edge, top edge, and the right edge of the guide panel, and the inner panel is disposed in front of the blower to guide the air discharged by the blower toward the outlet.

According to an embodiment of the disclosure, the outlet includes a first area adjacent a left edge of the guide panel, a second area adjacent a top edge of the guide panel, and a third area adjacent a right edge of the guide panel.

According to an embodiment of the disclosure, the suck-in flow path includes a flow-in port communicating with the outlet to bring in the second portion of the air, the flow-in port extending along a left edge, a top edge, and a right edge of the guide panel, and a flow-out port configured to discharge the second portion of the air, introduced through the flow-in port, into the housing, and the guide panel is configured so that the first portion of the air passing through the first area is discharged through the outlet toward the right, the first portion of the air passing through the second area is discharged through the outlet downward, and the first portion of the air passing through the third area is discharged through the outlet toward the left.

According to an embodiment of the disclosure, the suck-in flow path includes a flow-in port communicating with the outlet to bring in the second portion of the air, the flow-in port extending along a left edge, a top edge, and a right edge of the guide panel, and a flow-out port configured to discharge the second portion of the air, introduced through the flow-in port, into the housing, and the outer panel includes a guide curve connected to the flow-in port on one side of the guide curve to guide the first portion of the air discharged through the outlet toward a center of the outer panel.

According to an embodiment of the disclosure, the outlet includes a first area adjacent the left edge of the guide panel, a second area adjacent the top edge of the guide panel, and a third area adjacent the right edge of the guide panel, and the guide curve includes a first curve guiding the first portion of the air discharged through the outlet from the first area to the right, a second curve guiding the first portion of the air discharged through the outlet from the second area downward, and a third curve guiding the first portion of the air discharged through the outlet from the third area to the left.

According to an embodiment of the disclosure, the suction fan is disposed in the back of the inner panel.

According to an embodiment of the disclosure, the suck-in flow path includes a flow-in port communicating with the outlet to bring in the second portion of the air, the flow-in port extending along a left edge, a top edge, and a right edge of the guide panel, and a flow-out port configured to discharge the second portion of the air, introduced through the flow-in port, into the housing, and the guide panel further includes a flow-out duct coupled to a rear of the inner panel, a portion of the suck-in flow path being formed in the flow-out duct, and the flow-out port being provided at one end of the flow-out duct, and the suction fan is disposed in the flow-out duct.

According to an embodiment of the disclosure, the inner panel includes a coupling hook protruding rearward from a rear surface of the inner panel to be fixed to the housing.

BRIEF DESCRIPTION OF THE DRAWINGS

These and/or other embodiments of the disclosure will become apparent and more readily appreciated from the following description of the embodiments, taken in conjunction with the accompanying drawings of which.

DETAILED DESCRIPTION

Figure 1:
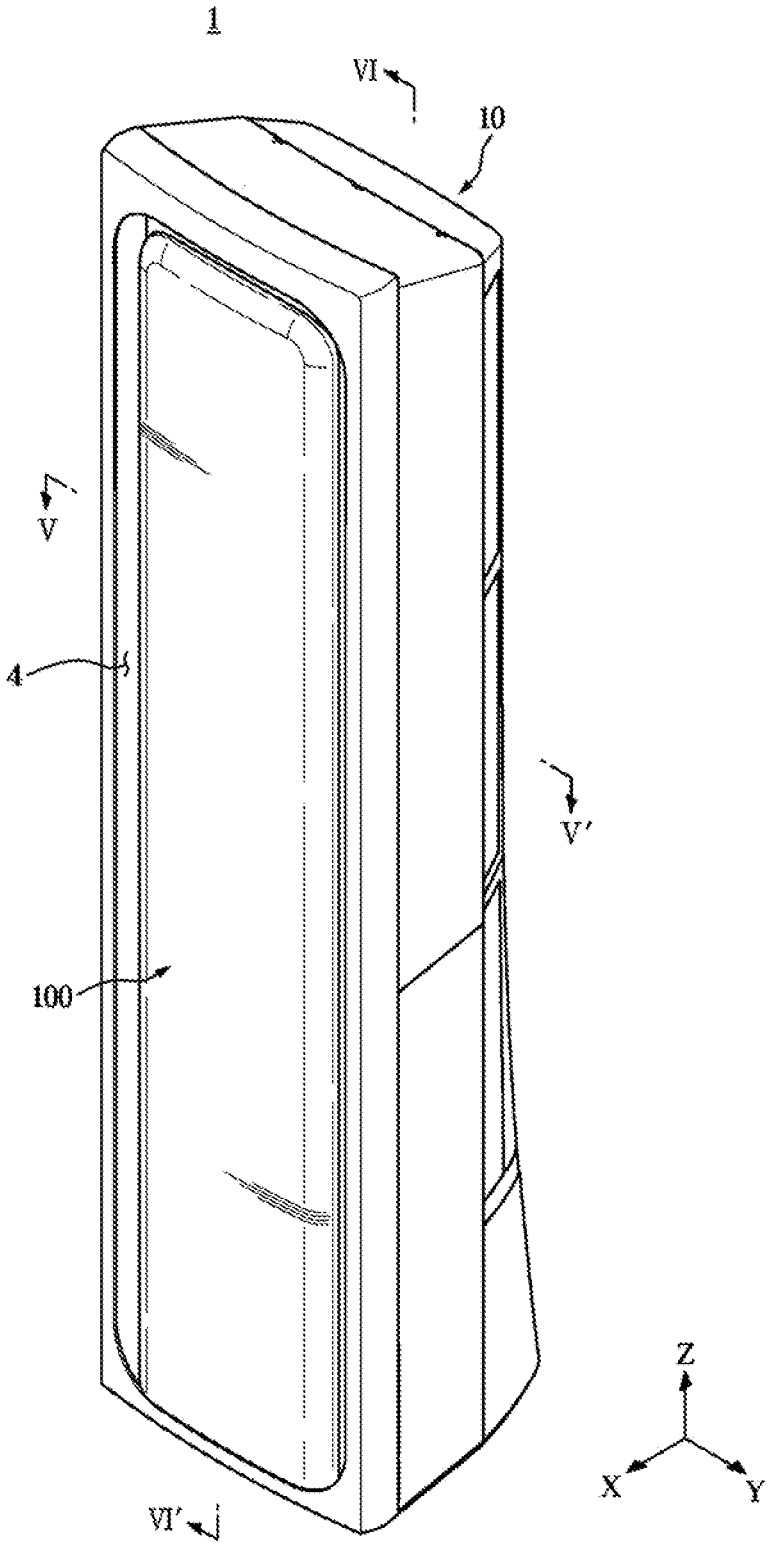
FIG. 1 is a perspective view of an air conditioner, according to an embodiment of the disclosure.

Embodiments and features as described and illustrated in the disclosure are merely examples, and there may be various modifications replacing the embodiments and drawings at the time of filing this application.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or room discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

Figure 2:
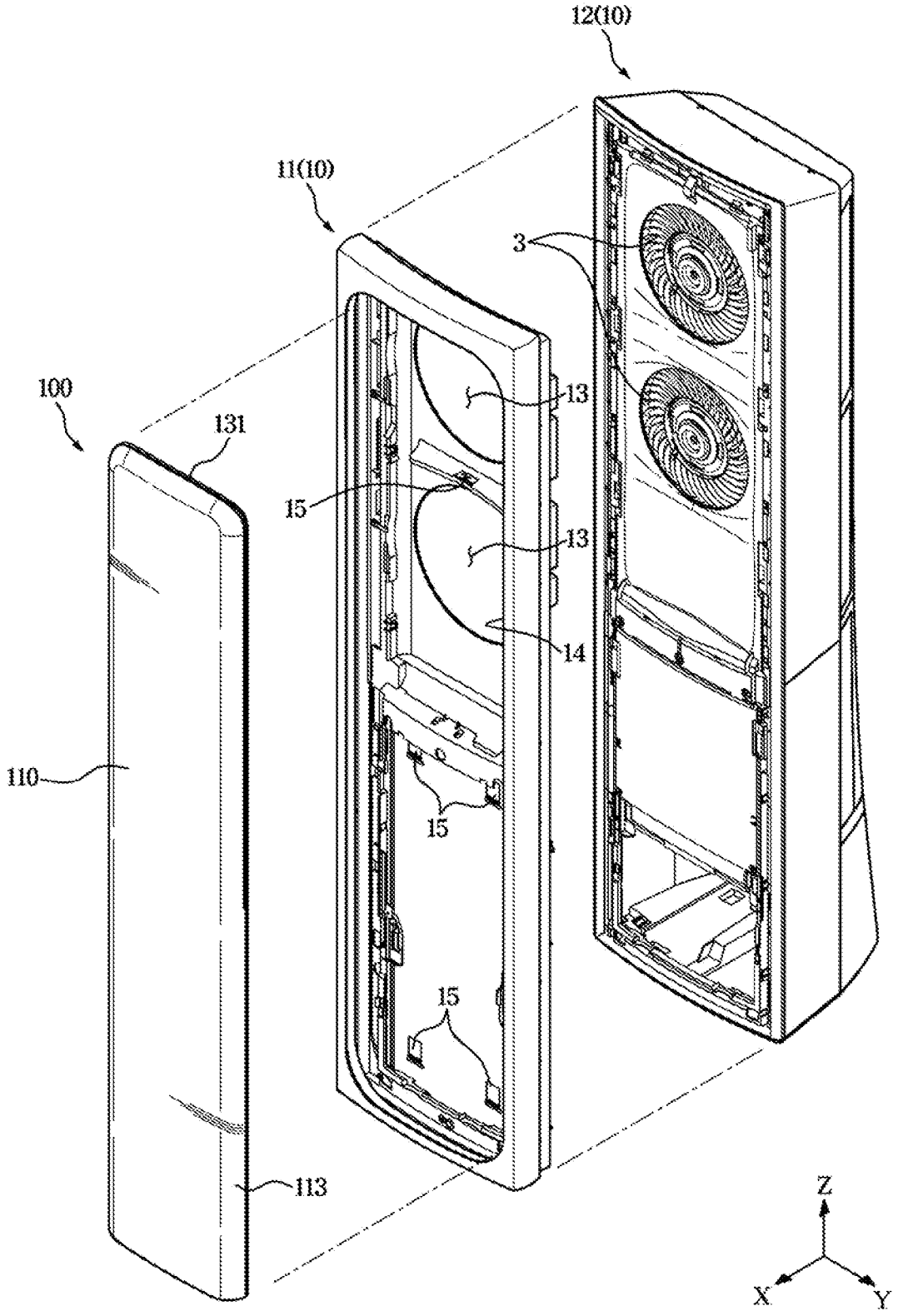
FIG. 2 is an exploded perspective view of the air conditioner shown in FIG. 1 according to an embodiment of the disclosure.

The terms "forward (or front)", "rearward (or behind)", "left", and "right" as herein used are defined with respect to the drawings, but the terms may not restrict the shape and position of the respective components. Specifically, as shown in FIG. 2, a direction X in which a guide panel is separated from a housing is defined as forward, based on which rearward, left and right, and upward and downward are defined.

Embodiments of the disclosure may provide an air conditioner capable of maintaining pleasant indoor temperature or humidity while having wind velocity of cooling of the air conditioner that is almost imperceptible to the user. Embodiments of the disclosure may also provide an air conditioner which uses components of the traditional air conditioner, thereby saving the manufacturing costs.

Embodiments of the disclosure may provide an air conditioner including a housing; a blower provided in the housing; a guide panel disposed in front of the blower to guide air discharged by the blower to edges of the guide panel; and a guide rib disposed to enclose edges of the guide panel to form a flow path together with the guide panel, and protruding from the housing in a forward direction of the guide panel, wherein an inner surface of the guide panel may guide air discharged by the blower to the guide rib, and the guide rib may guide the air guided by the guide panel toward a center of an outer surface of the guide panel. The guide rib may include a first rib covering a left corner of the guide panel and protruding from the left edge of the housing, a second rib covering a top edge of the guide panel and protruding from the top edge of the housing, and a third rib covering a right corner of the guide panel and protruding from the right edge of the housing. The first rib may guide the air guided by the guide panel toward the right, the second rib may guide the air guided by the guide panel downward, and the third rib may guide the air guided by the guide panel to the left. The guide rib may bend toward the center of the guide panel. The outer surface of the guide panel may convexly bend forward or concavely bend rearward.

According to embodiments of the disclosure, air discharged through an outlet of an air conditioner is guided by a guide panel and moved down the air conditioner. Accordingly, the user located in a distant range from the air conditioner may control indoor temperature or humidity without feeling direct wind velocity of cooling.

The air conditioner according to embodiments of the disclosure may be manufactured by using a main frame and components in the main frame of the traditional air conditioner and installing only an extra front frame and the extra guide panel, thereby saving the manufacturing costs.

Reference will now be made in detail to embodiments of the disclosure, which are illustrated in the accompanying drawings.

A refrigeration cycle of an air conditioner is comprised of a compressor, a condenser, an expansion valve, and an evaporator. The refrigeration cycle repeats a series of processes of compression, condensation, expansion and evaporation, allowing hot air to exchange heat with a cold refrigerant and thus supplying cool air into the indoor space.

The compressor compresses a gas refrigerant into a high temperature and high pressure state and discharges the compressed gas refrigerant, and the discharged gas refrigerant flows into the condenser. The condenser condenses the compressed refrigerant into a liquid state, and releases heat to the surroundings in the condensation process. The expansion valve expands the high temperature and high pressure liquid refrigerant condensed by the condenser to low pressure liquid refrigerant. The evaporator evaporates the refrigerant expanded by the expansion valve. The evaporator attains a cooling effect by exchanging heat with an object to be cooled using latent heat of vaporization of the refrigerant. With this cycle, the indoor air temperature may be controlled.

An outdoor unit of the air conditioner refers to a part comprised of the compressor of the refrigeration cycle and an outdoor heat exchanger. The expansion valve may be in one of the indoor unit or the outdoor unit, and the indoor heat exchanger may be in the indoor unit of the air conditioner.

The disclosure relates to an air conditioner for cooling an indoor space, in which case the outdoor heat exchanger serves as the condenser and the indoor heat exchanger serves as the evaporator. For convenience, the indoor unit including the indoor heat exchanger will now be referred to as the air conditioner and the indoor heat exchanger as the heat exchanger.

FIG. 1 is a perspective view of an air conditioner, according to an embodiment of the disclosure. FIG. 2 is an exploded perspective view of the air conditioner shown in FIG. 1.

Referring to FIGS. 1 and 2, an air conditioner 1 includes a housing 10 with an inlet (not shown) formed on the rear side and an outlet 4 formed on the front, a heat exchanger 2 (see FIG. 5) arranged in the housing 10 for exchanging heat with air brought into the housing 10 through the inlet, and a blower 3 for discharging the air having exchanged heat with the heat exchanger 2 to the outlet 4.

The blower 3 may be arranged in front of the heat exchanger 2. The blower 3 may suck in air behind the blower 3 and discharge the air forward from the blower 3. The housing 10 may form top, bottom, left, right and rear sides of the air conditioner 1 and form part of the front side.

Specifically, the housing 10 may include a main frame 12 that receives the blower 3, the heat exchanger 2 and various electric components, and a front frame 11 arranged in front of the main frame 12 to form a part of the front side of the air conditioner 1. The front frame 11 may be arranged in front of the main frame 12.

The front frame 11 may include an air blow hole 13 arranged to match the blower 3 arranged in the main frame 12 to allow air discharged by the blower 3 to pass through. An opening 14 open to the front may be formed on the front side of the front frame 11 to allow a guide panel 100, which will be described below, to be arranged therein. The front frame 11 may include a hook groove 15 coupled with a coupling hook 150 (see FIG. 4) of the guide panel 100 as will be described below.

The air conditioner 1 may include the guide panel 100 that forms the front of the air conditioner 1 and covers the blower 3 by being arranged in front of the blower 3. The guide panel 100 may be arranged within the opening 14 of the front frame 11.

The guide panel 100 may form the outlet 4 of the air conditioner 1 together with the front frame 11. Specifically, a separated space between outer edges of the opening 14 and the guide panel 100 may correspond to the outlet 4. As the guide panel 100 is spaced forward from the wind blow hole 13, the air discharged forward by the blower 3 may pass an air blow path 5 (see FIG. 5) formed between the air blow hole 13 and the guide panel 100 and may then be discharged out of the air conditioner 1 through the outlet 4.

In this case, the guide panel 100 may control an air current by sucking in part of the air passing the outlet 4 to the inside of the guide panel 100 so that the rest of the air flows down the air conditioner 1. As such, as the air discharged from the outlet 4 moves down the air conditioner 1 instead of moving forward, up, or to a side of the air conditioner 1, a pleasant indoor temperature or humidity may be maintained as well as the user is prevented from feeling the wind velocity of cooling of the air conditioner 1.

Figure 3:
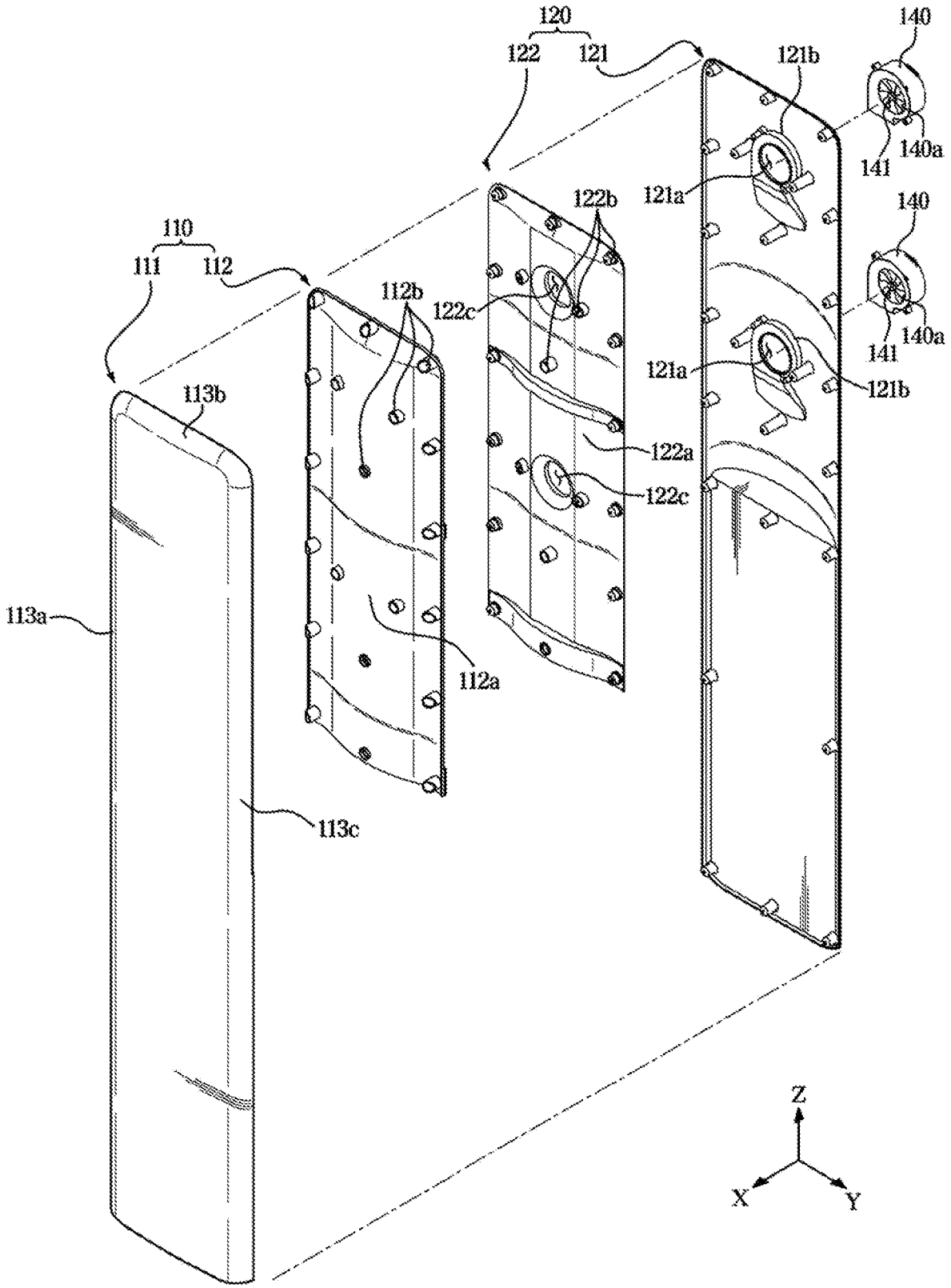
FIG. 3 is an exploded perspective view of a guide panel shown in FIG. 2 according to an embodiment of the disclosure.
Figure 4:
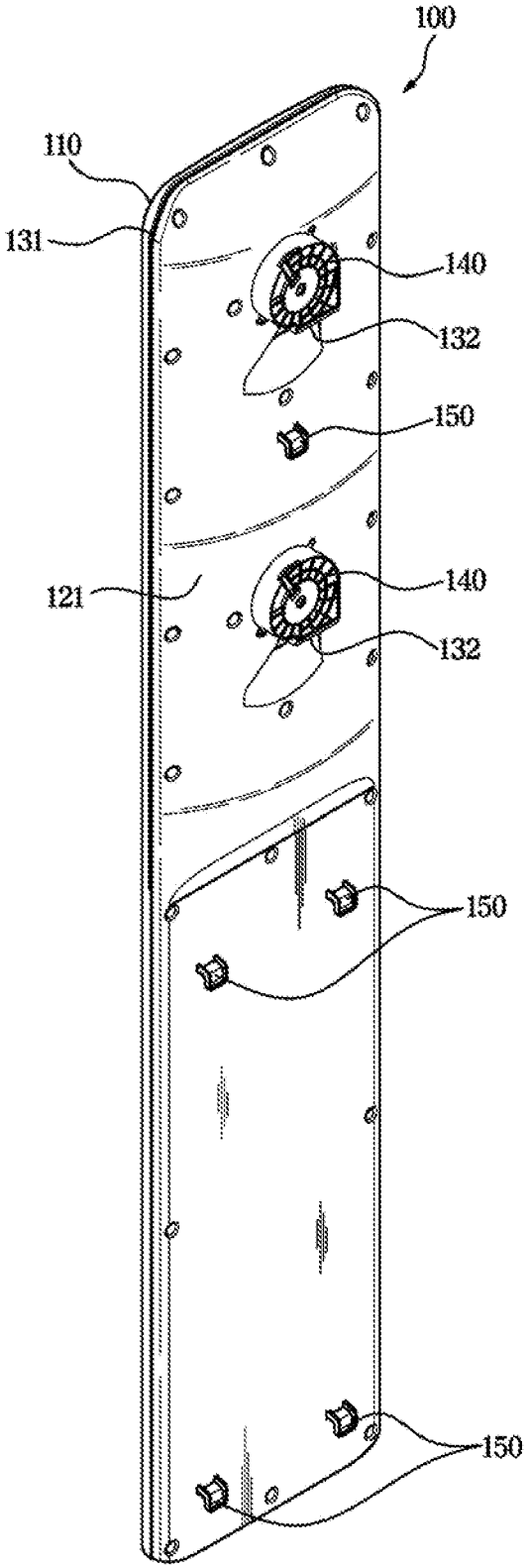
FIG. 4 illustrates a rear surface of the guide panel shown in FIG. 2 according to an embodiment of the disclosure.
Figure 5:
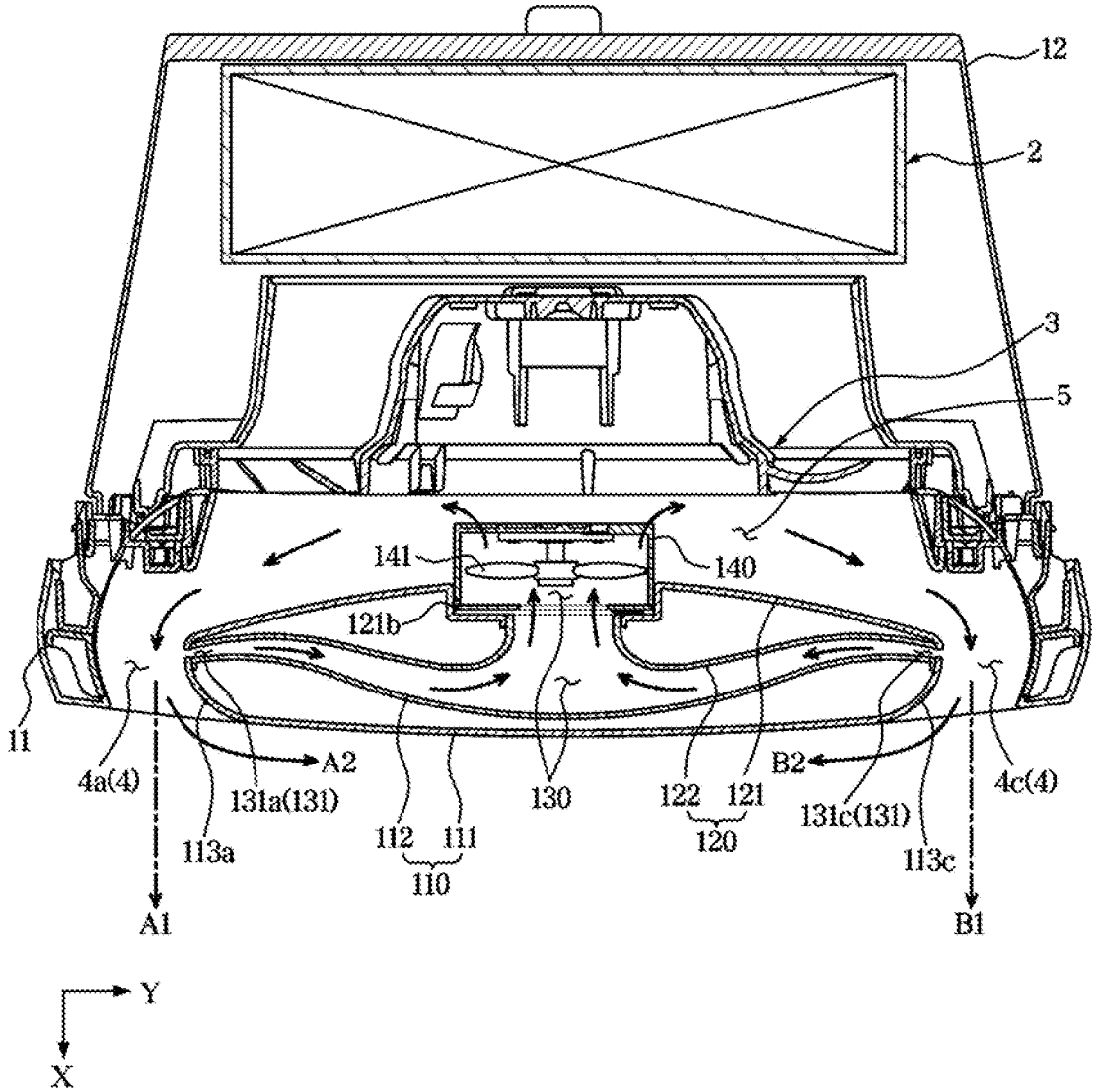
FIG. 5 is a cross-sectional view illustrating a cross section along indicated line V-V' of the air conditioner shown in FIG. 1 according to an embodiment of the disclosure.
Figure 6:
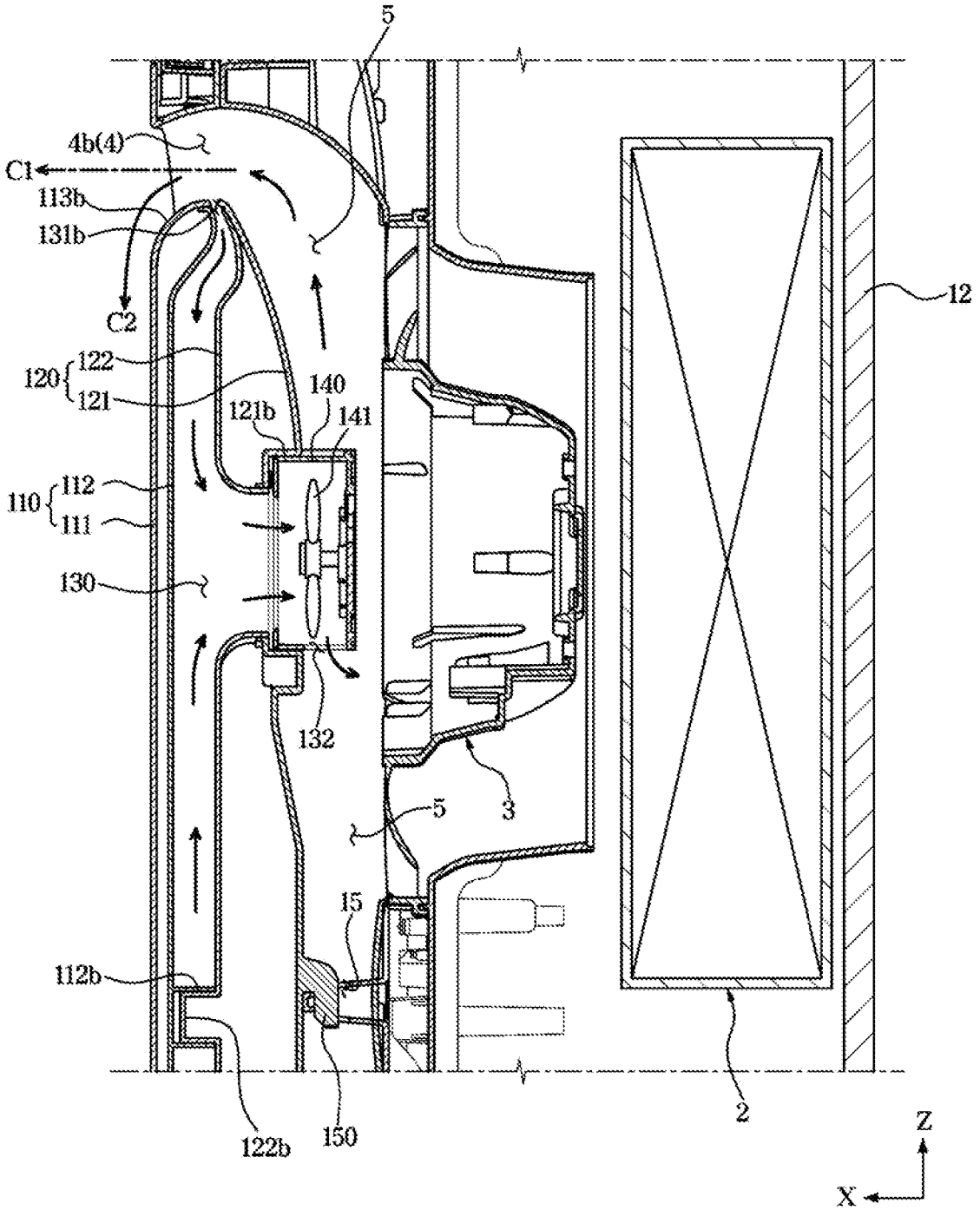
FIG. 6 is a cross-sectional view illustrating part of a cross section along indicated line VI-VI' of the air conditioner shown in FIG. 1 according to an embodiment of the disclosure.

FIG. 3 is an exploded perspective view of a guide panel shown in FIG. 2. FIG. 4 illustrates a rear surface of the guide panel shown in FIG. 2. FIG. 5 is a cross-sectional view illustrating a cross section along indicated line V-V' of the air conditioner shown in FIG. 1. FIG. 6 is a cross-sectional view illustrating part of a cross section along indicated line VI-VI' of the air conditioner shown in FIG. 1.

A structure and mechanism of the guide panel will now be described in detail with reference to the drawings.

Referring to FIGS. 3 to 6, the guide panel 100 may include an outer panel 110 that forms a front surface of the air conditioner 1, and an inner panel 120 arranged behind the outer panel 110 and coupled with the outer panel 110 and having the coupling hook 150 formed thereon to fix the guide panel 100 to the front frame 11.

The guide panel 100 may include the coupling hook 150. The coupling hook 150 may have the shape of '¬' by protruding from the rear surface of the inner panel 120, extending rearward, and bending downward. As the coupling hook 150 is inserted downward to the hook groove 15 formed on the front frame 11, the guide panel 100 may be detachably fixed to the front frame 11.

The guide panel 100 may include a suck-in flow path 130 into which part of the air discharged from the outlet 4 may be sucked. Specifically, the suck-in flow path 130 may be formed between the outer panel 110 and the inner panel 120 when the outer panel 110 and the inner panel 120 are coupled to each other. In other words, the suck-in flow path 130 may be formed by the outer panel 110 and the inner panel 120.

Specifically, the outer panel 110 may include a front plate 111 that forms the front look of the air conditioner 1 and a first inner wall structure 112 coupled to the rear surface of the front plate 111, and the inner panel 120 may include a rear plate 121 that forms the rear surface of the guide panel 100 and a second inner wall structure 122 coupled to the front surface of the rear plate 121.

The first inner wall structure 112 and the second inner wall structure 122 are separated from each other, forming the suck-in flow path 130 between the first inner wall structure 112 and the second inner wall structure 122.

Specifically, the first inner wall structure 112 may include a first duct wall 112*a* and a plurality of fasteners 112*b* protruding forward or rearward from the first duct wall 112*a*. The second inner wall structure 122 may include a second duct wall 122*a* and a plurality of couplers 122*b* matching the plurality of fasteners 112*b* and protruding forward from the second duct wall 122*a*. The suck-in flow path 130 may be formed between the first duct wall 112*a* and the second duct wall 122*a*. In other words, the suck-in flow path 130 may correspond to a separated space between the first duct wall 112*a* and the second duct wall 122*a*.

Each of the plurality of couplers 122*b* may be inserted and coupled to the matching fastener 112*b* (see FIG. 6). The fastener 112*b* protruding rearward may be longer than the coupler 122*b* protruding forward in the front-rear direction. It is not, however, limited thereto, and each of the plurality of fasteners 112*b* may be inserted and coupled to the matching coupler 122*b*. As the coupler 122*b* protrudes from the front surface of the second duct wall 122*a* or the fastener 112*b* protrudes from the rear surface of the first duct wall 112*a*, when the coupler 122*b* is coupled to the fastener 112*b*, the first inner wall structure 112 and the second inner wall structure 122 may be coupled to each other to make the first duct wall 112*a* and the second duct wall 122*a* spaced from each other. In other words, the first inner wall structure 112 and the second inner wall structure 122 may be connected to each other only at the fastener 112*b* and the coupler 122*b* and separated from each other in the other portions.

A length of the first inner wall structure 112 in the vertical direction Z may be shorter than a length of the front plate 111 in the vertical direction Z. A length of the second inner wall structure 122 in the vertical direction Z may be shorter than a length of the rear plate 121 in the vertical direction Z.

The first inner wall structure 112 and the front plate 111 may be coupled to each other to form the outer panel 110. The second inner wall structure 122 and the rear plate 121 may be coupled to each other to form the inner panel 120. It is not, however, limited thereto, and the front plate 111 and the first inner wall structure 112 may be integrally formed and the rear plate 121 and the second inner wall structure 122 may be integrally formed. Furthermore, the outer panel 110 and the inner panel 120 may be integrally formed.

The guide panel 100 may include a flow-in port 131 corresponding to an entrance of the suck-in flow path 130. The flow-in port 131 may extend along a left edge, a top edge and a right edge of the guide panel 100. The flow-in port 131 may extend along the outlet 4 to match the outlet 4. A portion of the flow-in port 131 extending along the left edge of the guide panel 100 and a portion of the flow-in port 131 extending along the right edge of the guide panel 100 may each have a length in the vertical direction Z, which is equal to or shorter than the length of the guide panel 100 in the vertical direction Z.

Specifically, the flow-in port 131 may include a first gap 131*a* that is a separated space between the left edge of the outer panel 110 and the left edge of the inner panel 120, a second gap 131*b* that is a separated space between the top edge of the outer panel 110 and the top edge of the inner panel 120, and a third gap 131*c* that is a separated space between the right edge of the outer panel 110 and the right edge of the inner panel 120.

The first to third gaps 131*a-c* may be integrally interconnected. It is not, however, limited thereto, and the first to third gaps 131*a-c* may be separated not to be interconnected. In this case, each of the first to third gaps 131*a-c* may correspond to one flow-in port 131, and the guide panel 100 may be considered to have a plurality of flow-in ports 131.

The guide panel 100 may include a flow-out port 132 corresponding to an exit of the suck-in flow path 130. The flow-out port 132 may be arranged on the rear surface of the guide panel 100. The flow-out port 132 may be open upward, downward, to the left or right rather than rearward to be less affected by the blower fan 3 that discharges air forward. Air in the suck-in flow path 130 may be released into the housing 10 through the flow-out port 132. In other words, the suck-in flow path 130 may be connected to the air blow path 5 at the flow-out port 132. The flow-out port 132 may include a plurality of flow-out ports 132.

The guide panel 100 may include a suction fan 141 that forms an air current in the suck-in flow path 130. The suction fan 141 may include a plurality of suction fans 141. When the suction fan 141 is activated, part of the air around the outlet 4 may flow into the suck-in flow path 130 through the flow-in port 131, and the air sucked in through the flow-in port 131 may be released into the housing 10 through the flow-out port 132 of the guide panel 100.

The suction fan 141 may be arranged in the suck-in flow path 130. Specifically, the suction fan 141 may be arranged in a flow-out duct 140 located on the rear surface of the inner panel 120 and having the suck-in flow path 130 formed inside.

The guide panel 100 may include the flow-out duct 140 that receives the suction fan 141 and forms the flow-out port 132 of the guide panel 100. As the flow-out port 132 of the guide panel 100 is formed at one end of the flow-out duct 140, the one end of the flow-out duct 140 may be connected to the space in the housing 10, and the other end of the flow-out duct 140 may be connected to a separated space between the first inner wall structure 112 and the second inner wall structure 122, which corresponds to the suck-in flow path 130.

Specifically, a first through hole 122*c* may be formed on the second inner wall structure 122, a second through hole 121*a* matching the first through hole 122*c* may be formed on the rear plate 121, and a third through hole 140*a* matching the second through hole 121*a* may be formed in the flow-out duct 140. As the flow-out duct 140 is coupled to the rear surface of the inner panel 120, the first to third through holes 122*c*, 121*a* and 140*a* form an integrated through hole 122*c*, 121*a* and 140*a* that passes through the inner panel 120 and the flow-out duct 140, and a portion of the suck-in flow path 130 formed by the first inner wall structure 112 and the second inner wall structure 122 and a portion of the suck-in flow path 130 formed by the flow-out duct 140 are connected to each other through the through hole 122*c*, 121*a* and 140*a*. The through hole 122*c*, 121*a* and 140*a* may be provided in the plural to match a plurality of flow-out ducts 140.

The flow-out duct 140 may be arranged on the back of the rear plate 121 and fixed to the rear surface of the rear plate 121. Specifically, the rear plate 121 may include a duct fixing groove 121*b* to which the flow-out duct 140 may be inserted and fixed, and the flow-out duct 140 may be inserted and coupled to the duct fixing groove 121*b*. The through holes 122*c*, 121*a* and 140*a* may be formed on one side of the duct fixing groove 121*b*.

However, it is not limited thereto. The flow-out duct 140 may be omitted, in which case, the suction fan 141 may be arranged between the front plate 111 and the rear plate 121. Specifically, the suction fan 141 may be arranged in the suck-in flow path 130 formed by the first inner wall structure 112 and the second inner wall structure 122, and the through hole 122*c* and 121*a* formed by coupling between the first through hole 122*c* and the second through hole 121*a* may correspond to the flow-out port 132.

The front plate 111 may include a guide curve 113 formed on the front surface of the front plate 111 to guide a discharged air current, the direction of which is changed according to suction force of the suction fan 141, to a preset direction according to Coanda effect, as will be described below. The guide curve 113 may be connected to the flow-in port 131 on one side, and arranged to adjoin the outlet 4. The guide curve 113 may extend along the flow-in port 131. The guide curve 113 may extend along the outlet 4.

The guide curve 113 may include a first curve 113*a* connected to the first gap 131*a*, a second curve 113*b* connected to the second gap 131*b*, and a third curve 113*c* connected to the third gap 131*c*.

The rear plate 121 may be arranged in front of the blower 3 to block the progress of air moved forward by the blower 3, and the rear surface of the rear plate 111 may guide air to the top edge, left edge and right edge of the guide panel 100 so that the air blown by the blower 3 may be moved toward the outlet 4 enclosing the guide panel 100.

The air having exchanged heat with the heat exchanger 2 may be discharged by the blower 3 through the outlet 4. In this case, the guide panel 100 may change the direction of progress of the air discharged through the outlet 4 by sucking in part of air around the outlet 4. In other words, a direction in which a discharged air current discharged out of the housing 10 through the outlet 4 progresses may be changed by suction force of the suction fan 141 that works on the air passing the out 4 through the suck-in flow path 130 to a direction different from a direction of progress of a discharged air current when the suction fan 141 is not activated.

Specifically, the outlet 4 may include a first area 4*a* adjacent to the left edge of the guide panel 100, a second area 4*b* adjacent to the top edge of the guide panel 100, and a third area 4*c* adjacent to the right edge of the guide panel 100, and the guide panel 100 may guide each of an air current discharged through the first area 4*a*, an air current discharged through the second area 4*b* and an air current discharged through the third area 4*c* to a different direction.

The first area 4*a* may be arranged on the left of the guide panel 100 and may extend in the vertical direction Z in parallel with the guide panel 100, the second area 4*b* may be arranged on an upper portion of the guide panel 100 and may extend in the horizontal direction Y in parallel with the guide panel 100, and the third area 4*c* may be arranged on the right of the guide panel 100 and may extend in the vertical direction Z in parallel with the guide panel 100. An end of the first area 4*a* may be connected to an end of the second area 4*b*, and an end of the third area 4*c* may be connected to the other end of the second area 4*b*. It is not, however, limited thereto, and the first to third areas 4*a-c* may be separated not to be connected to each other.

As shown in FIG. 5, when a direction of progress of a discharged air current discharged from the first area 4*a* when the guide panel 100 is not activated is the A1 direction, the guide panel 100 may be activated to change the direction of progress of the discharged air current of the first area 4*a* to the A2 direction by sucking air from the right of the A1 direction into the suck-in flow path 130. In other words, part of the air discharged through the first area 4*a* may be sucked into the suck-in flow path 130 through the first gap 131*a*, and the direction of progress of the discharged air current discharged forward from the first area 4*a* may be changed to the right. At the same time, the first curve 113*a* may also guide the discharged air current discharged from the first area 4*a* to the right.

Furthermore, when a direction of progress of a discharged air current discharged from the third area 4*c* when the guide panel 100 is not activated is the B1 direction, the guide panel 100 may be activated to change the direction of progress of the discharged air current of the third area 4*c* to the B2 direction by sucking air from the left of the B1 direction into the suck-in flow path 130. In other words, part of the air discharged through the third area 4*c* may be sucked into the suck-in flow path 130 through the third gap 131*c*, and the direction of progress of the discharged air current discharged forward from the third area 4*c* may be changed to the left. At the same time, the third curve 113*c* may also guide the discharged air current discharged from the third area 4*c* to the left.

As shown in FIG. 6, when a direction of progress of a discharged air current discharged from the second area 4*b* when the guide panel 100 is not activated is the C1 direction, the guide panel 100 may be activated to change the direction of progress of the discharged air current of the second area 4*b* to the C2 direction by sucking air from a lower side of the C1 direction into the suck-in flow path 130. In other words, part of the air discharged through the second area 4*b* may be sucked into the suck-in flow path 130 through the second gap 131*b*, and the direction of progress of the discharged air current discharged forward from the second area 4*b* may be changed to the downward direction. At the same time, the second curve 113*b* may also guide the discharged air current discharged from the second area 4*b* downward.

The air flowing into the suck-in flow path 130 through the first to third gaps 131*a-c* may be released into the housing 10 through the flow-out port 132 and moved back through the air blow path 5 and discharged to the outside through the outlet 4.

As such, the air discharged through the outlet 4 is guided by the guide panel 100 to be moved to the center of the outside of the guide panel 100, and moved down the air conditioner 1 on the whole by the air discharged from the second area 4*b* and guided downward. Accordingly, the user located in a range distant from the air conditioner may control indoor temperature or humidity without feeling direct wind velocity of cooling.

Furthermore, the air conditioner 1 shown in FIG. 1 may be manufactured by continuing to use the main frame 12 and components in the main frame 12 of the traditional air conditioner and separately installing only the front frame 11 and the guide panel 100, thereby saving the manufacturing cost.

Figure 7:
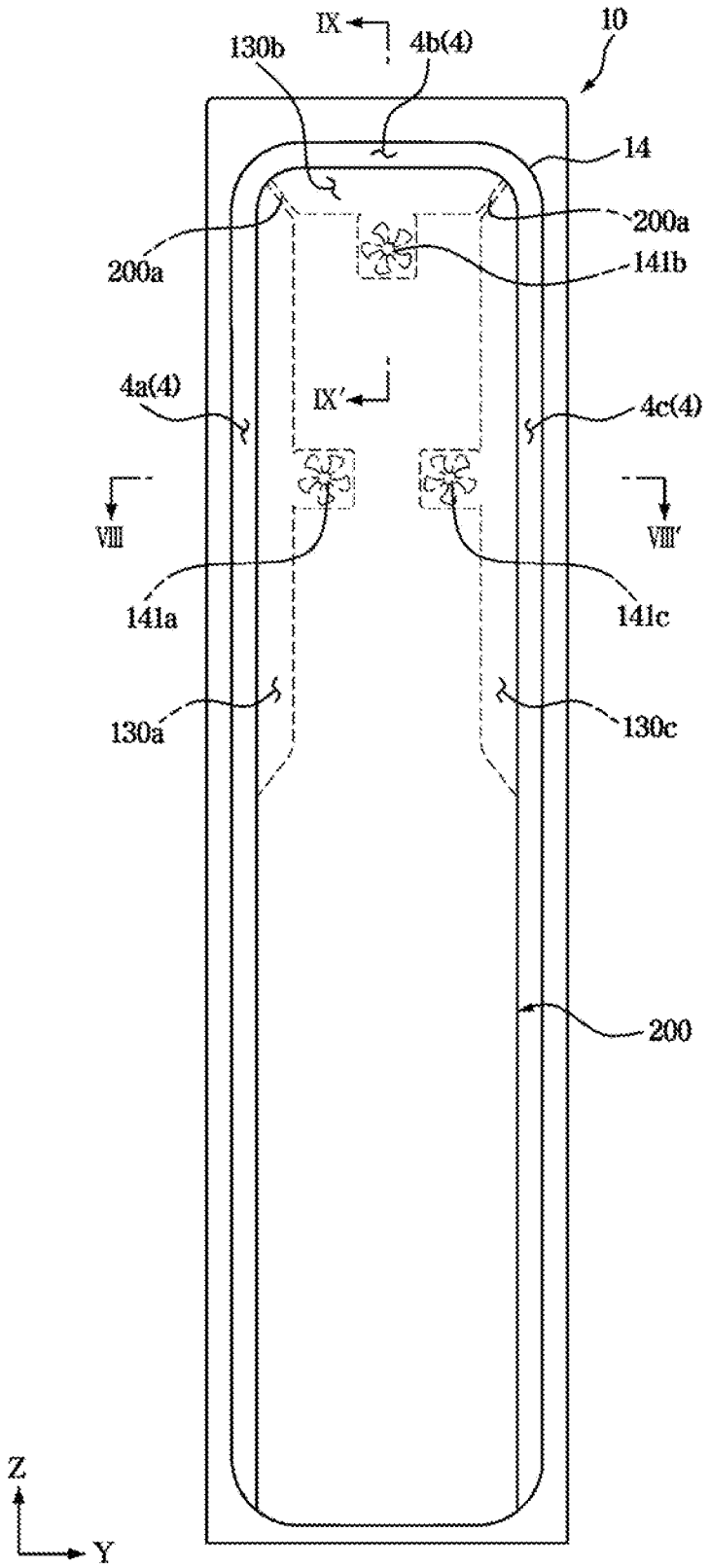
FIG. 7 schematically illustrates the air conditioner of FIG. 1 including a guide panel according to another embodiment of the disclosure.
Figure 8:
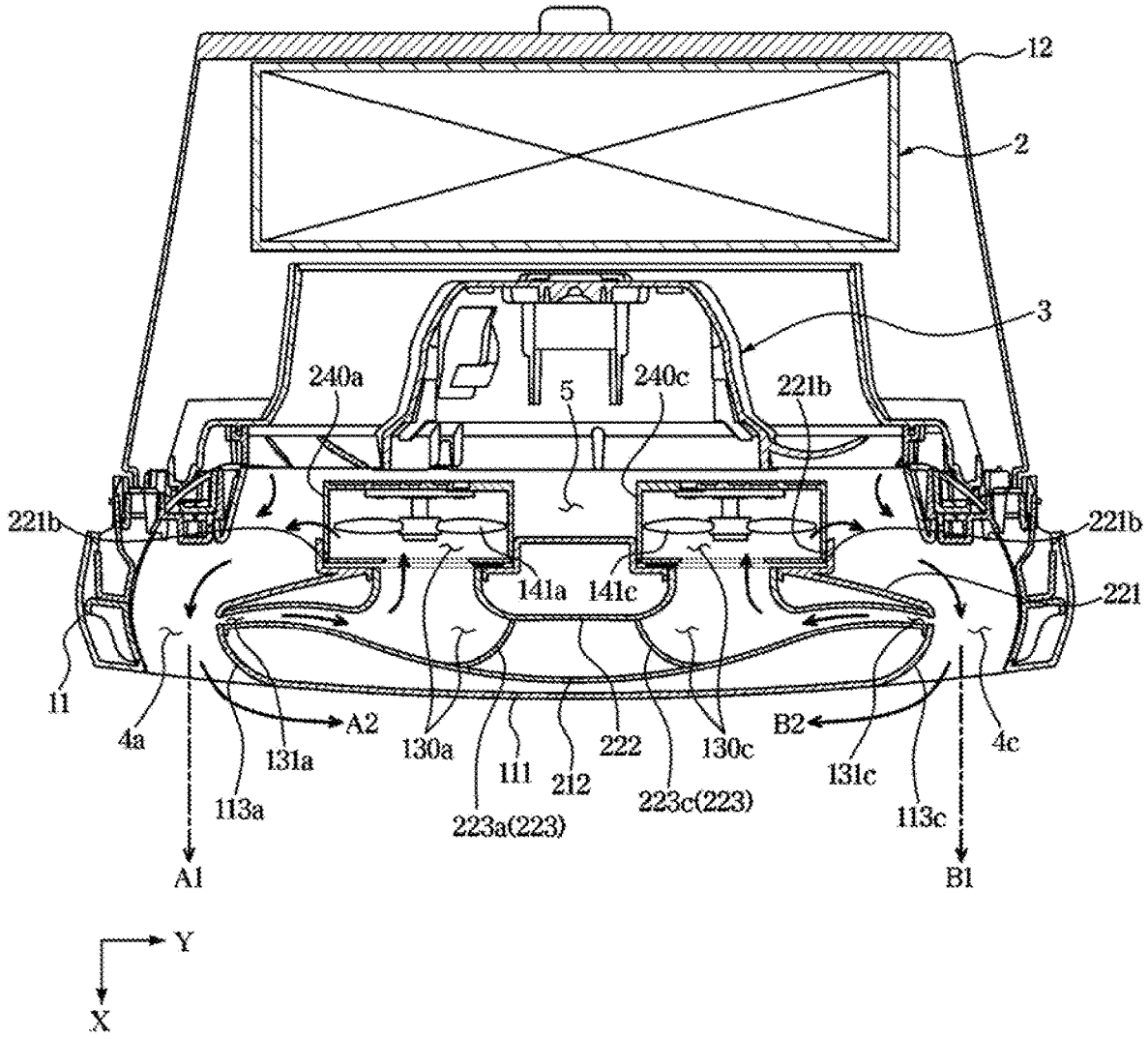
FIG. 8 is a cross-sectional view illustrating a cross section along indicated line VIII-VIII' of the air conditioner shown in FIG. 7 according to an embodiment of the disclosure.
Figure 9:
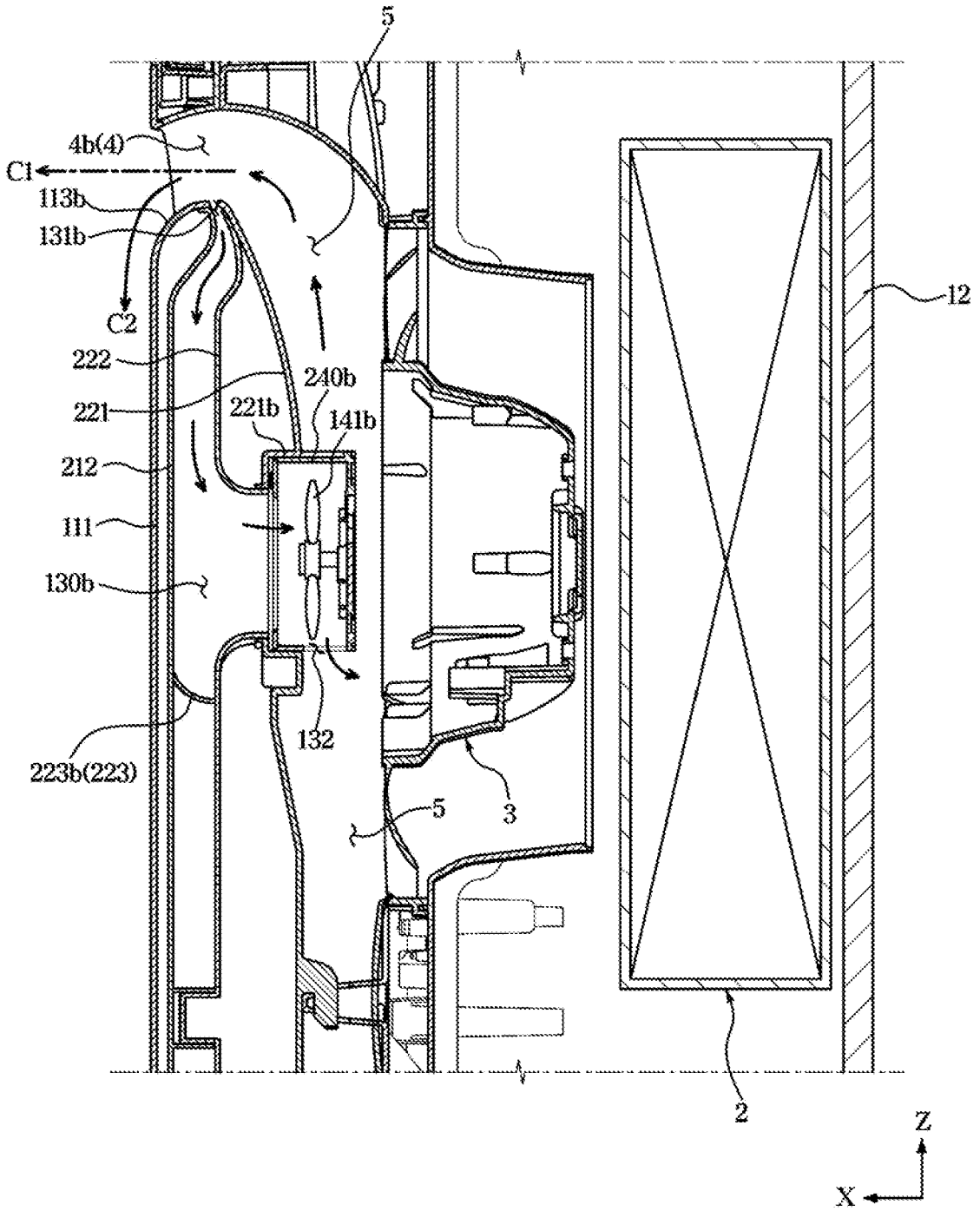
FIG. 9 is a cross-sectional view illustrating part of a cross section along indicated line IX-IX' of the air conditioner shown in FIG. 7 according to an embodiment of the disclosure.

FIG. 7 schematically illustrates the air conditioner of FIG. 1 including a guide panel according to another embodiment. FIG. 8 is a cross-sectional view illustrating a cross section along indicated line VIII-VIII' of the air conditioner shown in FIG. 7. FIG. 9 is a cross-sectional view illustrating part of a cross section along indicated line IX-IX' of the air conditioner shown in FIG. 7.

As shown in FIGS. 7 to 9, a guide panel 200 may include the plurality of suck-in flow paths 130*a-c*. The plurality of suck-in flow paths 130*a-c* may include a first suck-in flow path 130*a* connected to the first gap 131*a*, a second suck-in flow path 130*b* connected to the second gap 131*b*, and a third suck-in flow path 130*c* connected to the third gap 131*c*.

As blocking plates 200*a* may be arranged between the first suck-in flow path 130*a* and the second suck-in flow path 130*b* and between the second suck-in flow path 130*b* and the third suck-in flow path 130*c*, the first to third suck-in flow paths 130*a-c* may be separated not to be connected to each other. The blocking plates 200*a* may be arranged between the first inner wall structure 112 and the second inner wall structure 122.

The first suck-in flow path 130*a* and the third suck-in flow path 130*c* may extend in the vertical direction Z, and the second suck-in flow path 130*b* may extend in the horizontal direction Y.

The guide panel 200 may include a first suction fan 141*a* arranged in the first suck-in flow path 130*a*, a second suction fan 141*b* arranged in the second suck-in flow path 130*b*, and a third suction fan 141*c* arranged in the third suck-in flow path 130*c*.

Specifically, the guide panel 200 may include a first flow-out duct 240*a* with the first suck-in flow path 130*a* formed therein, a second flow-out duct 240*b* with the second suck-in flow path 130*b* formed therein, and a third flow-out duct 240*c* with the third suck-in flow path 130*c* formed therein, the first suction fan 141*a* is arranged in the first flow-out duct 240*a*, the second suction fan 141*b* is arranged in the second flow-out duct 240*b*, and the third suction fan 141*c* is arranged in the third flow-out duct 240*c*. The flow-out port 132 may be formed at each of the flow-out ducts 240*a-c*, and each of the flow-out ducts 240*a-c* may be inserted and fixed to a duct fixing groove 221*b* matching the flow-out duct 240*a-c*.

The guide panel 200 may include a flow path wall 223 arranged between the first inner wall structure 212 and the second inner wall structure 222 to form the first suck-in flow path 130*a*, the second suck-in flow path 130*b* and the third suck-in flow path 130*c*. Specifically, the flow path wall 223 may include a first flow path wall 223*a* forming the first suck-in flow path 130*a* with the first inner wall structure 212 and the second inner wall structure 222, a second flow path wall 223*b* forming the second suck-in flow path 130*b* with the first inner wall structure 212 and the second inner wall structure 222, and a third flow path wall 223*c* forming the third suck-in flow path 130*c* with the first inner wall structure 212 and the second inner wall structure 222.

The first flow path wall 223*a* and the third flow path wall 223*c* may extend in the vertical direction Z. The second flow path wall 223*b* may extend in the horizontal direction Y. At least one of the first flow path wall 223*a*, the second flow path wall 223*b*, and the third flow path wall 223*c* may be integrally formed with the first inner wall structure 212 or the second inner wall structure 222. At least two of the first flow path wall 223*a*, the second flow path wall 223*b*, and the third flow path wall 223*c* may be integrally formed. The flow path wall 223 and the blocking plate 200*a* may be integrally formed.

As such, as one suction fan 141*a-c* is arranged in each of the plurality of suck-in flow paths 130*a-c* and the suck-in flow paths 130*a-c* are separated from each other, the user may operate a desired one of the plurality of suction fans 141*a-c* to separately control each of the discharged air currents discharged from the first area 4*a*, the second area 4*b* and the third area 4*c*.

However, it is not limited thereto. The first suck-in flow path 130*a* and the second suck-in flow path 130*b* may be integrally connected by omitting the blocking plate 200*a* between the first suck-in flow path 130*a* and the second suck-in flow path 130*b*, the second suck-in flow path 130*b* and the third suck-in flow path 130*c* may be integrally connected by omitting the blocking plate 200*a* between the second suck-in flow path 130*b* and the third suck-in flow path 130*c*, or the first to third suck-in flow paths 130*a-c* may be integrally connected by omitting all the blocking plates 200*a*.

Figure 10:
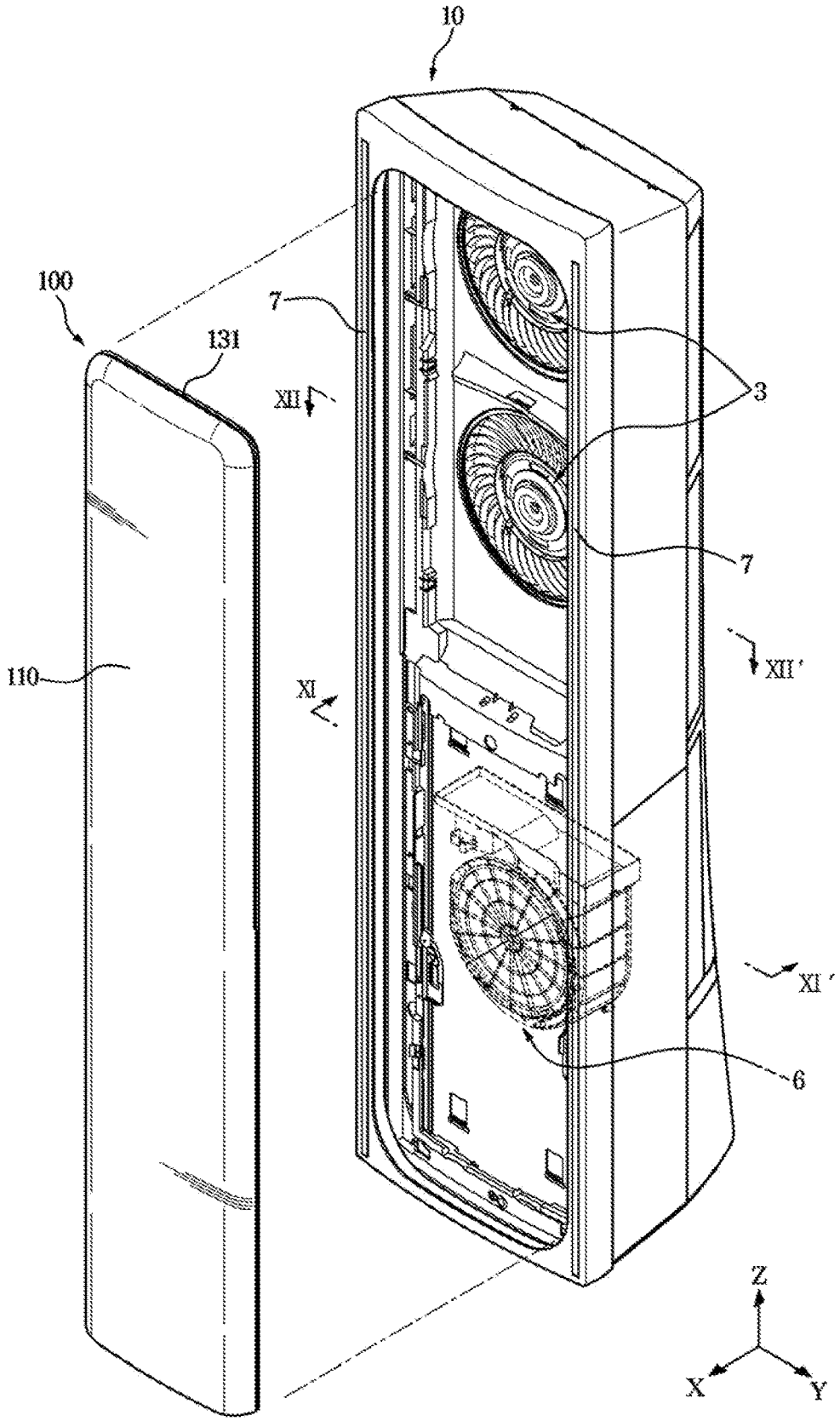
FIG. 10 illustrates an air conditioner, according to another embodiment of the disclosure.
Figure 11:
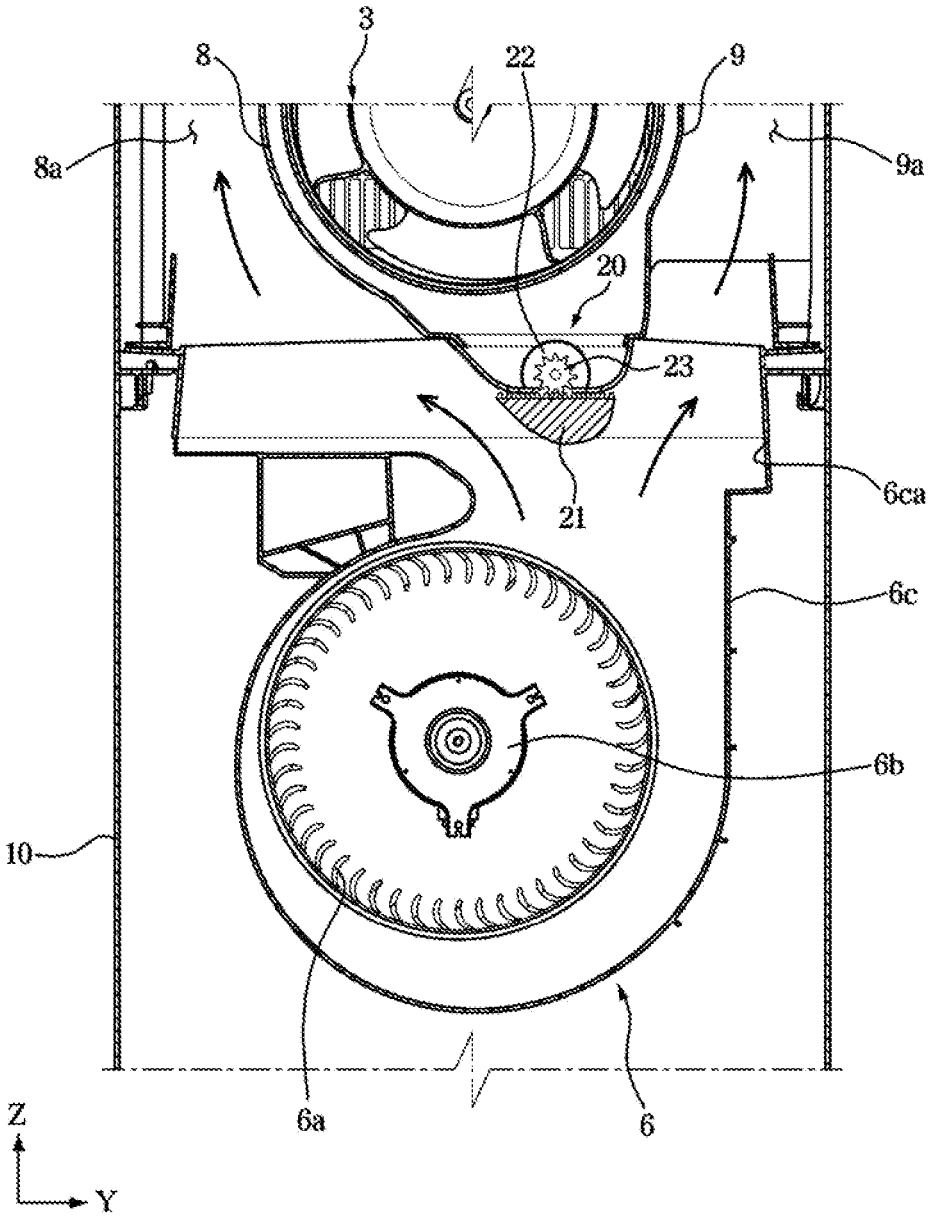
FIG. 11 is a cross-sectional view illustrating a cross section along indicated line XI-XI' of the air conditioner shown in FIG. 10 according to an embodiment of the disclosure.
Figure 12:
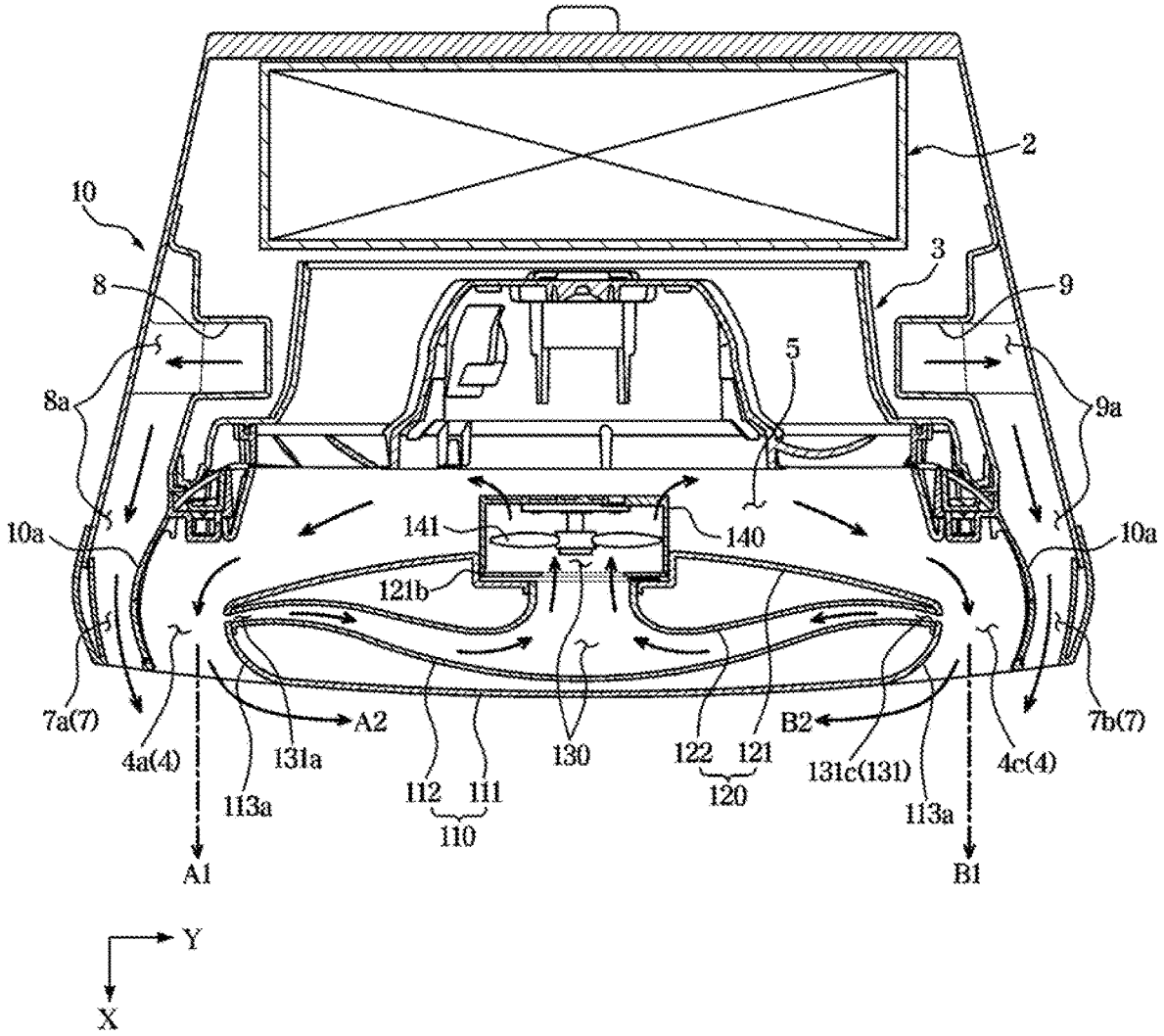
FIG. 12 is a cross-sectional view illustrating a cross section along indicated line XII-XII' of the air conditioner shown in FIG. 10 according to an embodiment of the disclosure.

FIG. 10 illustrates an air conditioner according to another embodiment. FIG. 11 is a cross-sectional view illustrating a cross section along indicated line XI-XI' of the air conditioner shown in FIG. 10. FIG. 12 is a cross-sectional view illustrating a cross section along indicated line XII-XII' of the air conditioner shown in FIG. 10.

Referring to FIGS. 10 to 12, an air conditioner may include an auxiliary outlet 7 formed on the front of the housing 10, and a second blower 6 for discharging a discharged air current out of the air conditioner through the auxiliary outlet 7. The second blower 6 may be arranged under the first blower 3.

The auxiliary outlet 7 may include a first auxiliary outlet 7*a* formed on the left edge of the housing 10 and a second auxiliary outlet 7*b* formed on the right edge of the housing 10. The housing 10 may include a partition wall 10*a*, which may separate the first auxiliary outlet 7*a* from the first area 4*a* of the outlet 4 and separate the second auxiliary outlet 7*b* from the third area 4*c* of the outlet 4. Accordingly, the auxiliary outlet 7 may be separated from the outlet 4. In other words, the partition wall 10*a* may form the first auxiliary outlet 7*a* and the second auxiliary outlet 7*b*. The partition wall 10*a* may form a portion of a first auxiliary flow path 8*a* and a portion of a second auxiliary flow path 9*a*.

It is not, however, limited thereto, and the partition wall 10*a* may be omitted. Accordingly, the outlet 4 and the auxiliary outlet 7 may be integrally formed. In this case, the air blown by the second blower 6 may be discharged out of the housing 10 through the outlet 4. Specifically, the air blown by the second blower 6 may reach the first area 4*a* along the first auxiliary flow path 8*a* to be discharged out of the housing 10, and may reach the third area 4*c* along the second auxiliary flow path 9*a* to be discharged out of the housing 10.

The second blower 6 may include a blower fan 6*a*, a fan driver 6*b*, and a fan body case 6*c*.

The blower fan 6*a* may employ a centrifugal fan, but it is not limited thereto and may be any configuration that moves the air brought into the housing 10 from outside through a suction port (not shown) formed on the housing 10 to be discharged back to the outside of the housing 10. For example, the blower fan 6*a* may be a cross fan, a turbo fan, or a sirocco fan. The description of the blower fan 6*a* of the second blower 6 may be equally applied to the blower fan of the first blower 3.

The fan driver 6*b* may drive the blower fan 6*a* and include a motor.

The fan body case 6*c* may be fixed to the inside of the housing 10 and may cover the blower fan 6*a*. The fan body case 6*c* may include a fan inlet (not shown) through which air is brought in, and the fan outlet 6*ca* through which air is discharged.

The air conditioner may include a first duct 8 arranged in the housing 10 and separating the first auxiliary flow path 8*a* from the air blow path 5. The first duct 8 may be arranged on the left to the first blower 3, extending vertically and having almost the same shaped cross-sections in the vertical direction. The first auxiliary flow path 8*a* may be formed in the first duct 8.

The first duct 8 may have one end connected to the fan outlet 6*ca* of the second blower 6 and the other end connected to the first auxiliary outlet 7*a*. Accordingly, the first auxiliary flow path 8*a* may include a flow path connecting the second blower 6 to the first auxiliary outlet 7*a*. The first duct 8 may guide at least a portion of air blown by the second blower 6 to the first auxiliary outlet 7*a*. In other words, part of the air discharged from the second blower 6 may flow along the first auxiliary flow path 8*a* and may be discharged out of the air conditioner through the first auxiliary outlet 7*a*.

The air conditioner may include a second duct 9 arranged in the housing 10 and separating the second auxiliary flow path 9*a* from the air blow path 5. The second duct 9 may be arranged on the right to the first blower 3, extending vertically and having almost the same shaped cross-sections in the vertical direction. The second auxiliary flow path 9*a* may be formed in the second duct 9.

The second duct 9 may have one end connected to the fan outlet 6*ca* of the second blower 6 and the other end connected to the second auxiliary outlet 7*b*. Accordingly, the second auxiliary flow path 9*a* may include a flow path connecting the second blower 6 to the second auxiliary outlet 7*b*. The second duct 9 may guide at least a portion of air blown by the second blower 6 to the second auxiliary outlet 7*b*. In other words, part of the air discharged from the second blower 6 may flow along the second auxiliary flow path 9*a* and may be discharged out of the air conditioner through the second auxiliary outlet 7*b*.

The air conditioner may discharge air having exchanged heat with the heat exchanger 2 through the outlet 4 as the first blower 3 discharges the air having exchanged heat with the heat exchanger 2, and discharge air that has not passed the heat exchanger 2 through the auxiliary outlet 7 as the second blower 6 discharges the air that has not exchanged heat with the heat exchanger 2. It is not, however, limited thereto, and air that has exchanged heat with the heat exchanger 2 may be discharged through the auxiliary outlet 7 as the second blower 6 discharges the air that has exchanged with the heat exchanger 2.

The first blower 3 and the second blower 6 may be provided to be driven independently. The rotational speed of the first blower 3 may be different from the rotational speed of the second blower 6.

The air conditioner may include a distributor 20 arranged in the housing 10 to control a flow rate of air discharged through the first auxiliary outlet 7*a* and the second auxiliary outlet 7*b*. The distributor 20 may be arranged to be adjacent to the fan outlet 6*ca*. The distributor 20 may be arranged between the first auxiliary flow path 8*a* and the second auxiliary flow path 9*a*.

The distributor 20 may include a damper 21 for controlling a volume of air discharged to the first duct 8 and the second duct 9, a damper driving source 22, and a power transfer member 23. The damper driving source 22 may include a motor. The damper 21 may include a rack, and the power transfer member 23 may include a pinion. It is not, however, limited thereto, and the distributor 20 may include various driving mechanisms to move the damper 21 to the left or right.

The damper 21 may receive power of the damper driving source 22 through the power transfer member 23 to move to the left or right. The damper 21 may be moved to the left to block at least a portion of the first auxiliary flow path 8*a* so that air flows more to the second duct 9 than to the first duct 8, and the damper 21 may be moved to the right to block at least a portion of the second auxiliary flow path 9*a* so that air flows more to the first duct 8 than to the second duct 9.

Operations of the air conditioner as shown in FIG. 10 will be described in detail.

The air conditioner may be operated to discharge air that has exchanged heat with the heat exchanger 2 only through the outlet 4. This type of operation may be referred to as a first mode. As a discharged air current discharged through the outlet 4 may be guided by the guide panel 100 as described above, air conditioning may be generally slowly performed in the indoor space. The discharged air current discharged out of the housing 10 through the outlet 4 may be affected by suction force of the suction fan 141 arranged in the guide panel 100, thereby having a reduced forward wind velocity and proceeding down the housing 10 on the whole. With this structure, the user may cool or heat the room to stay himself/herself pleasant without directly contacting the discharged air current.

When the air conditioner is operated in the first mode, the first blower 3 and the suction fan 141 of the guide panel 100 are activated but the second blower 6 is not activated. The first blower 3 may suck in air outside the housing 10 through the inlet (not shown) formed on the rear side of the housing 10, the air sucked into the housing 10 may exchange heat while passing the heat exchanger 2 arranged in the housing 10, and the first blower 3 may discharge air in the back of the first blower 3 to a forward direction of the first blower 3 such that the air having exchanged heat with the heat exchanger 2 may flow in the air blow path 5 to be discharged out of the housing 10 through the outlet 4.

The air flowing in the air blow path 5 may reach the outlet 4, and part of air discharged out of the housing 10 through the outlet 4 may be sucked into the suck-in flow path 130 of the guide panel 100 by the suction fan 141 of the guide panel 100 while the rest of the air may have a progress direction guided by the guide panel 100 to be discharged out of the housing 10.

As the second blower 6 is not operated in the first mode, the air is not discharged through the auxiliary outlet 7.

In the meantime, in the first mode, cool air or warm air discharged from the air conditioner may be supplied to various distances and/or in various directions by changing the driving power of the first blower 3 and/or the suction fan 141. For example, when the driving power of the first blower 3 is constant, the weaker the driving power of the suction fan 141, the smaller the extent of changing of the progress direction of the discharged air current discharged through the outlet 4, and when the driving power of the suction fan 141 is constant, the stronger the driving power of the first blower 3, the smaller the extent of changing of the progress direction of the discharged air current discharged through the outlet 4. In this case, that the extent of changing of the progress direction of the discharged air current discharged through the outlet 4 becomes smaller may mean that the discharged air current has a greater tendency to progress to the forward direction of the air conditioner. Accordingly, the user may control the air conditioner for the discharged air current to be moved downward by controlling the driving power of the first blower 3 and/or the suction fan 141, or control the air conditioner for the discharged air current to be moved toward a direction between the vertically downward direction and the horizontally forward direction.

The air conditioner may be operated to discharge air through the outlet 4 and the auxiliary outlet 7. This type of operation may be referred to as a second mode. In the second mode, the guide panel 100 may be deactivated. Accordingly, straightness of the discharged air current discharged through the outlet 4 and the auxiliary outlet 7 increases, and the air conditioner may discharge the cool air or warm air farther when operated in the second mode than in the first mode. The user may directly contact the discharged air current, and may cool or heat the room faster than in the first mode.

When the air conditioner is operated in the second mode, the first blower 3 and the second blower 6 are activated but the suction fan 141 of the guide panel 100 is not activated. The first blower 3 sucks air outside the housing 10 into the housing 10 through the inlet (not shown) as in the first mode, and discharges the air having exchanged heat with the heat exchanger 2 in the housing 10 toward the outlet 4. As the suction fan 141 is not activated, the discharged air current discharged through the outlet 4 may proceed to the substantially forward direction of the air conditioner without having the progress direction changed by the guide panel 100.

The second blower 6 may suck in air outside the housing 10 into the housing 10 through the inlet (not shown) formed on the rear side of the housing 10, and the air sucked into the housing 10 may pass the second blower 2 and may then be discharged by the second blower 6 to the first auxiliary flow path 8*a* and the second auxiliary flow path 9*a* formed on both sides of the air blow path 5. In this case, the inlet connected to the first blower 3 and the inlet connected to the second blower 6 may be equal to or different from each other. The air moved to the first auxiliary flow path 8*a* and the second auxiliary flow path 9*a* may be moved upward in the respective auxiliary flow paths 8*a* and 9*a* and then discharged out of the housing 10 through the first auxiliary outlet 7*a* and the second auxiliary outlet 7*b*. The discharged air current discharged through the auxiliary outlet 7 may proceed in the substantially forward direction of the air conditioner, and may be mixed and moved together with the discharged air current discharged through the outlet 4.

With this structure, the air conditioner may provide the user with pleasantly cool air or warm air resulting from the mixture of the heat-exchanged air and the indoor air when in the second mode. In addition, the air conditioner may be configured to provide cool air or warm air to various distances by changing driving power for the first blower 3 and/or the second blower 6. Specifically, the first blower 3 may be configured to control a volume and/or a rate of air discharged through the outlet 4, and the second blower 6 may be configured to control a volume and/or a rate of air discharged through the auxiliary outlet 7.

The air conditioner may be operated to discharge air only through the auxiliary outlet 7. This type of operation may be referred to as a third mode. There may be no heat exchanger provided in the auxiliary flow paths 8*a* and 9*a* or in the back of the second blower 6, and the air conditioner may circulate the indoor air.

When the air conditioner is operated in the third mode, the second blower 6 is activated while the first blower 3 and the suction fan 141 of the guide panel 100 are not activated. The second blower 6 may suck in air outside the housing 10 into the housing 10 through the inlet formed on the rear side of the housing 10, and the air sucked into the housing 10 may pass the second blower 2 and may then be discharged by the second blower 6 to the first auxiliary flow path 8*a* and the second auxiliary flow path 9*a* formed on both sides of the air blow path 5. The air moved to the first auxiliary flow path 8*a* and the second auxiliary flow path 9*a* may be moved upward in the respective auxiliary flow paths 8*a* and 9*a* and then discharged out of the housing 10 through the first auxiliary outlet 7*a* and the second auxiliary outlet 7*b*. The discharged air current discharged through the auxiliary outlet 7 may proceed in the substantially forward direction of the air conditioner.

As the first blower 3 is not activated in the third mode, the air is not discharged through the outlet 4. The air conditioner blows air that has not exchanged heat in the third mode, thereby performing a simple function of circulating indoor air or providing strong wind for the user.

Figure 13:
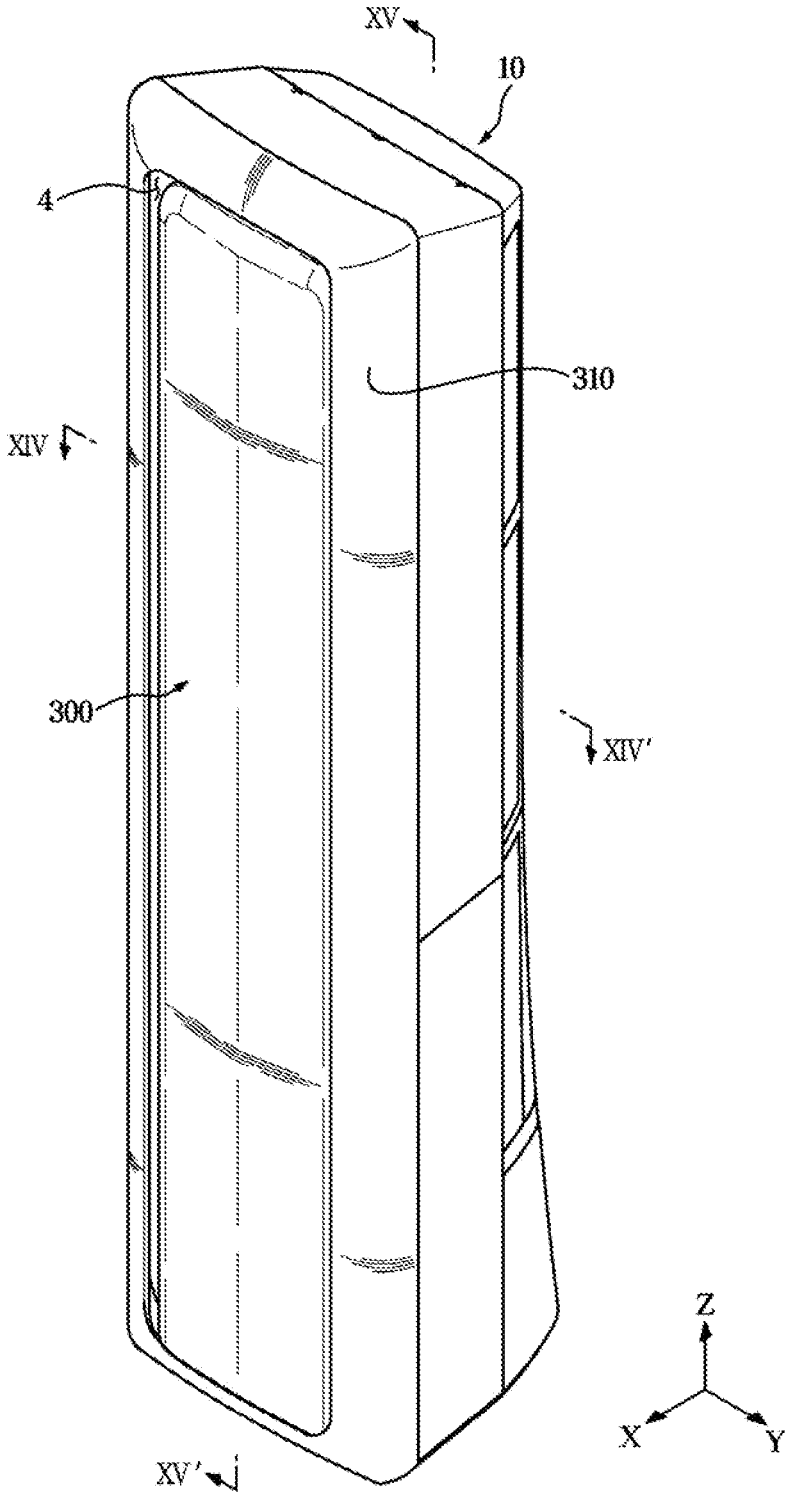
FIG. 13 is a perspective view of an air conditioner, according to another embodiment of the disclosure.
Figure 14:
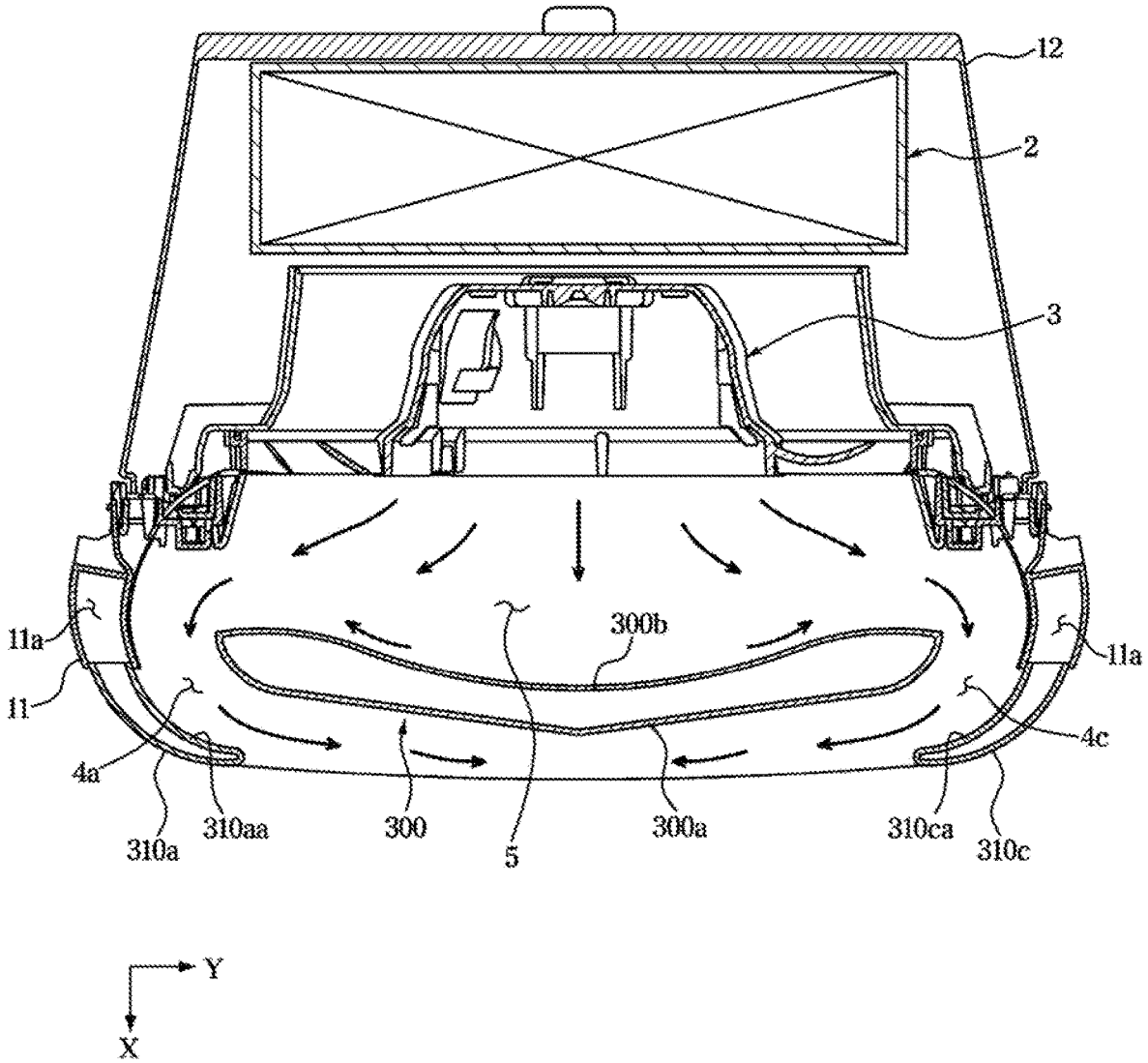
FIG. 14 is a cross-sectional view illustrating a cross section along indicated line XIV-XIV' of the air conditioner shown in FIG. 13 according to an embodiment of the disclosure.
Figure 15:
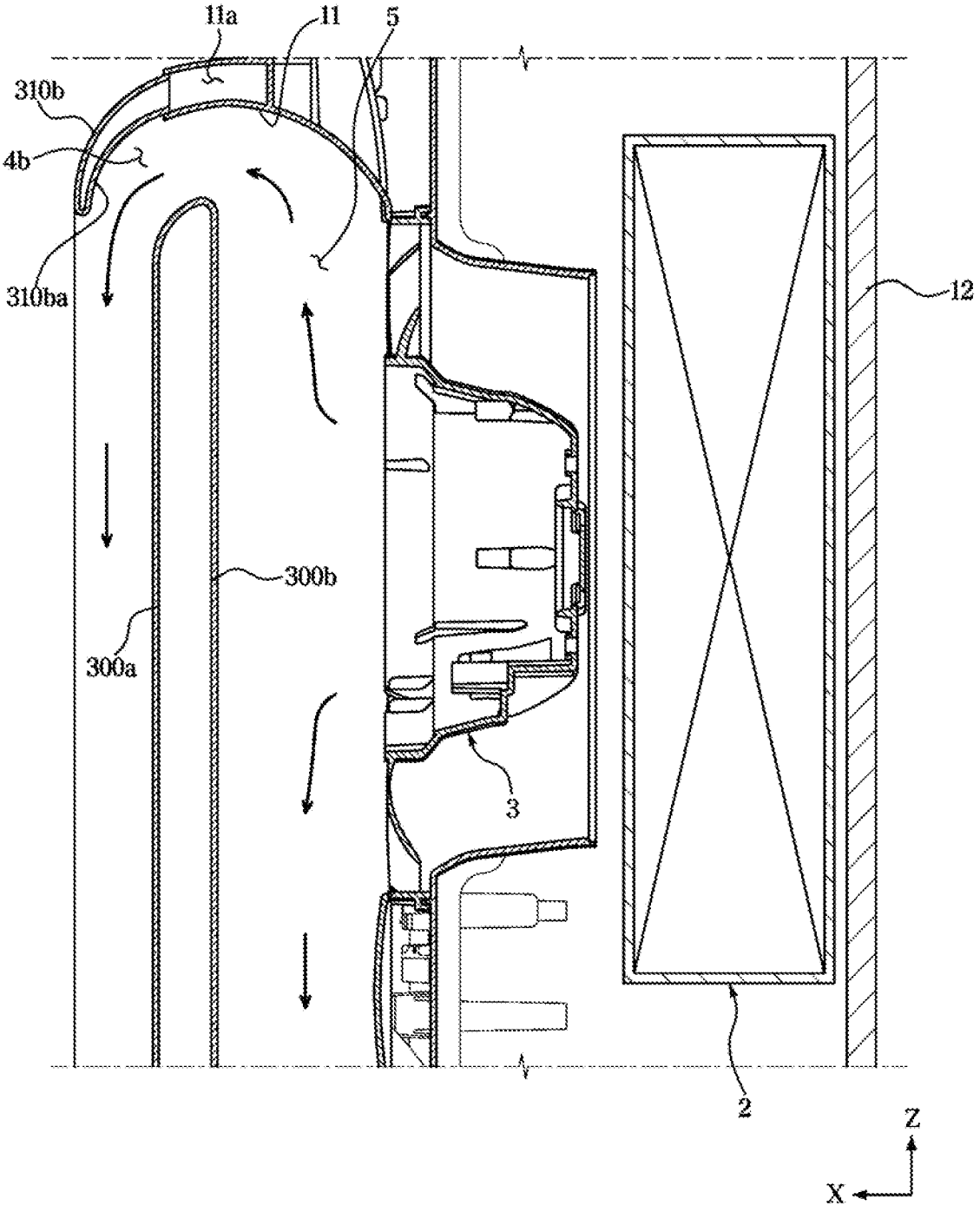
FIG. 15 is a cross-sectional view illustrating a cross section along indicated line XV-XV' of the air conditioner shown in FIG. 13 according to an embodiment of the disclosure.
Figure 16:
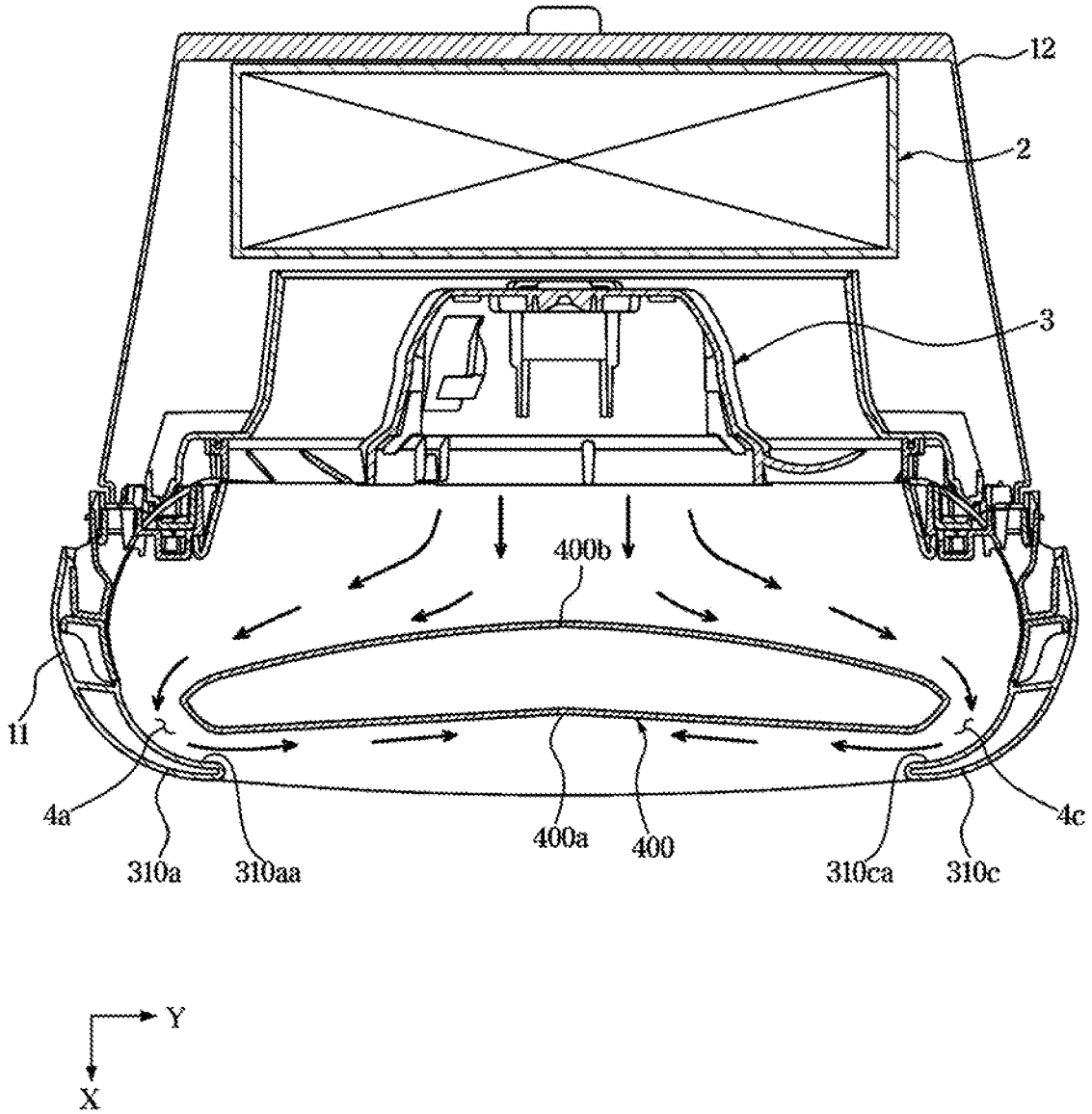
FIG. 16 illustrates the air conditioner of FIG. 13 including a guide panel according to another embodiment of the disclosure.

FIG. 13 is a perspective view of an air conditioner, according to another embodiment. FIG. 14 is a cross-sectional view illustrating a cross section along indicated line XIV-XIV' of the air conditioner shown in FIG. 13. FIG. 15 is a cross-sectional view illustrating a cross section along indicated line XV-XV' shown in FIG. 13. FIG. 16 illustrates the air conditioner of FIG. 13 including a guide panel according to another embodiment.

Referring to FIGS. 13 to 16, an air conditioner may include a guide rib 310 protruding forward from the front of the front frame 11 and guiding the discharged air current discharged through the outlet 4.

The guide rib 310 may be integrally formed with the front frame 11, or formed separately to be detachably coupled with the front frame 11. The guide rib 310 may be arranged to be spaced from a guide panel 300 and may cover the left edge, top edge and right edge of the guide panel 300.

The guide rib 310 may be embedded in the housing 10 not to protrude from the front of the housing 10 or to partially protrude, and may be pulled out from the inside of the housing 10 to protrude from the front of the housing 10 when required. Specifically, the guide rib 310 may be embedded in an embedding groove 11*a* matching the guide rib 310 and formed on the front frame 11, and pulled out from the embedding groove 11*a* to protrude from the front of the front frame 11 when required. The guide rib 310 may be embedded or pulled out manually, or automatically with an extra power device.

The guide rib 310 may include a first rib 310*a* protruding from the left edge of the front frame 11 and covering the left corner of the guide panel 300, a second rib 310*b* protruding from the top edge of the front frame 11 and covering the top edge of the front frame 11, and a third rib 310*c* protruding from the right edge of the front frame 11 and covering the right corner of the guide panel 300. At least two of the first to third ribs 310*a-c* may be integrally formed. It is not, however, limited thereto, and the first to third ribs 310*a-c* may all be separated.

The first rib 310*a* may be formed to protrude from the front frame 11 and then bend to the right to cover the left corner of an outer surface 300*a* of the guide panel 300, the second rib 310*b* may be formed to protrude from the front frame 11 and then bend downward to cover the top edge of the outer surface 300*a* of the guide panel 300, and the third rib 310*c* may be formed to protrude from the front frame 11 and then bend to the left to cover the right corner of the outer surface 300*a* of the guide panel 300.

In other words, the guide rib 310 may be formed to bend toward the center of the guide panel 300. In this case, the outer surface 300*a* of the guide panel 300 may correspond to the front surface 300*a* of the guide panel 300 based on FIG. 11, and an inner surface 300*b* of the guide panel 300 may correspond to the rear surface 300*b* of the guide panel 300 based on FIG. 11. Furthermore, an inner surface 310*aa*, 310*ba* or 310*ca* of the guide rib 310 may now be referred to as a rear surface of the guide rib 310 based on FIG. 14.

The inner surface 300*b* of the guide panel 300 may be arranged in front of the blower 3 to guide air discharged by the blower 3 to edges of the guide panel 300, and the outer surface 300*a* of the guide panel 300 may guide movement of the air discharged from the outlet 4.

As shown in FIG. 14, the outer surface 300*a* of the guide panel 300 and the inner surface 300*b* of the guide panel 300 may convexly bend forward. However, it is not limited thereto. For example, as shown in FIG. 16, an outer surface 400*a* of a guide panel 400 and an inner surface 400*b* of the guide panel 400 may concavely bend rearward. In another example, the outer surface 300*a* of the guide panel 300 may be swollen forward while the inner surface 300*b* may concavely bend rearward, or the outer surface 300*a* may be sunken rearward while the inner surface 300*b* may convexly bend forward.

The outlet 4 may include a separated space between the inner surface 310*aa*, 310*ba*, and 310*ca* of the guide rib 310 and the outer surface 300*a* of the guide panel 300. Specifically, the first area 4*a* of the outlet 4 may include a separated space between the inner surface 310*aa* of the first guide rib 310*a* and the outer surface 300*a* of the guide panel 300, the second area 4*b* of the outlet 4 may include a separated space between the inner surface 310*ba* of the second guide rib 310*b* and the outer surface 300*a* of the guide panel 300, and the third area 4*c* of the outlet 4 may include a separated space between the inner surface 310*ca* of the third guide rib 310*c* and the outer surface 300*a* of the guide panel 300, Accordingly, the first area 4*a* of the outlet 4 may be open to the right to discharge air to the right, the second area 4*b* of the outlet 4 may be open downward to discharge air downward, and the third area 4*c* of the outlet 4 may be open to the left to discharge air to the left. In other words, the first guide rib 310*a* may guide the discharged air current of the first area 4*a* to the right the second guide rib 310*b* may guide the discharged air current of the second area 4*b* downward, and the third guide rib 310*c* may guide the discharged air current of the third area 4*c* to the left The guide panel 300 and the guide rib 310 that require no extra power may be used to change the progress direction of the air discharged from the outlet 4 to the downward direction of the air conditioner on the whole, so that the user located in a range separated from the air conditioner may control indoor temperature or humidity without feeling direct wind velocity of cooling.

The air conditioner 1 including the guide panel 100 shown in FIG. 1 or the guide panel 200 shown in FIG. 7 may include the guide rib 310 as shown in FIGS. 13 to 16 as well.

Several embodiments of the disclosure have been described above, but a person of ordinary skill in the art will understand and appreciate that various modifications can be made without departing from the scope of the disclosure. Thus, it will be apparent to those or ordinary skill in the art that the true scope of technical protection is only defined by the following claims.

What is claimed is:

1. An air conditioner comprising:

a housing;

a heat exchanger disposed in the housing;

an outlet;

a blower configured to discharge air forward toward the outlet, the air having exchanged heat with the heat exchanger; and a guide panel covering a front of the blower, and including:

an outer panel, an inner panel coupled with the outer panel, and a suck-in flow path formed by the inner panel and the outer panel, wherein the guide panel is configured so that:

the guide panel forms the outlet with the housing to release a first portion of the air discharged by the blower outside of the housing, the outlet encloses a left edge, top edge, and right edge of the guide panel, and the suck-in flow path sucks in a second portion of the air discharged by the blower so as to guide the first portion of the air to flow outside of the housing in a direction different than when the second portion of the air is not sucked into the suck-in flow path.

2. The air conditioner of claim 1, wherein the guide panel further includes:

a suction fan disposed in the suck-in flow path to form an air current in the suck-in flow path.

3. The air conditioner of claim 1, wherein the inner panel is disposed behind the outer panel, and at least a portion of the suck-in flow path is disposed between the outer panel and the inner panel.

4. The air conditioner of claim 1, wherein the suck-in flow path includes:

a flow-in port communicating with the outlet to bring in the second portion of the air, and a flow-out port configured to release the second portion of the air, brought in through the flow-in port, into the housing.

5. The air conditioner of claim 4, wherein the flow-in port extends along a left edge, a top edge, and a right edge of the guide panel.

6. The air conditioner of claim 4, wherein the flow-in port includes a plurality of flow-in ports respectively formed at a left edge, a top edge, and a right edge of the guide panel.

7. The air conditioner of claim 2, wherein the suck-in flow path includes a plurality of suck-in flow paths, each including:

a flow-in port communicating with the outlet to bring in the second portion of the air, and the suction fan includes a plurality of suction fans respectively corresponding to each of the plurality of suck-in flow paths.

8. The air conditioner of claim 1, wherein the inner panel is disposed in front of the blower to guide the air discharged by the blower toward the outlet.

9. The air conditioner of claim 1, wherein the outlet includes:

a first area adjacent a left edge of the guide panel, a second area adjacent a top edge of the guide panel, and a third area adjacent a right edge of the guide panel.

10. The air conditioner of claim 9, wherein the suck-in flow path includes:

a flow-in port communicating with the outlet to bring in the second portion of the air, the flow-in port extending along a left edge, a top edge, and a right edge of the guide panel, and a flow-out port configured to discharge the second portion of the air, introduced through the flow-in port, into the housing, and the guide panel is configured so that:

the first portion of the air passing through the first area is discharged through the outlet toward the right, the first portion of the air passing through the second area is discharged through the outlet downward, and the first portion of the air passing through the third area is discharged through the outlet toward the left.

11. The air conditioner of claim 1, wherein the suck-in flow path includes:

a flow-in port communicating with the outlet to bring in the second portion of the air, the flow-in port extending along a left edge, a top edge, and a right edge of the guide panel, and a flow-out port configured to discharge the second portion of the air, introduced through the flow-in port, into the housing, and the outer panel includes:

a guide curve connected to the flow-in port on one side of the guide curve to guide the first portion of the air discharged through the outlet toward a center of the outer panel.

12. The air conditioner of claim 11, wherein the outlet includes:

a first area adjacent the left edge of the guide panel, a second area adjacent the top edge of the guide panel, and a third area adjacent the right edge of the guide panel, and the guide curve includes:

a first curve guiding the first portion of the air discharged through the outlet from the first area to the right, a second curve guiding the first portion of the air discharged through the outlet from the second area downward, and a third curve guiding the first portion of the air discharged through the outlet from the third area to the left.

13. The air conditioner of claim 2, wherein the suction fan is disposed in a back of the inner panel.

14. The air conditioner of claim 13, wherein the suck-in flow path includes:

a flow-in port communicating with the outlet to bring in the second portion of the air, the flow-in port extending along a left edge, a top edge, and a right edge of the guide panel, and a flow-out port configured to discharge the second portion of the air, introduced through the flow-in port, into the housing, and the guide panel further includes:

a flow-out duct coupled to a rear of the inner panel, a portion of the suck-in flow path being formed in the flow-out duct, and the flow-out port being provided at one end of the flow-out duct, and the suction fan is disposed in the flow-out duct.

15. The air conditioner of claim 1, wherein the inner panel includes a coupling hook protruding rearward from a rear surface of the inner panel to be fixed to the housing.

* * * * *